United States Patent [19]

Levee et al.

[11] Patent Number: 4,740,108

[45] Date of Patent: Apr. 26, 1988

[54] METHOD AND APPARATUS FOR SELECTING AND MAINTAINING THE LEVEL OF A PIER DECK

[75] Inventors: Leonard E. Levee, P.O. Box 504, Lyons, Tex. 77863; Rainer Kuenzel, Houston, Tex.

[73] Assignee: Leonard Edward Levee, Lyons, Tex.

[21] Appl. No.: 890,063

[22] Filed: Jul. 24, 1986

[51] Int. Cl.[4] ..... E02B 17/00

[52] U.S. Cl. ..... 405/221; 405/196; 405/198; 405/218

[58] Field of Search ..... 405/195, 196, 198, 199, 405/200, 203, 218, 219, 221, 224, 227

[56] References Cited

U.S. PATENT DOCUMENTS

| | | | |
|---|---|---|---|
| 2,430,014 | 11/1947 | Hansen | 405/196 |
| 2,686,491 | 8/1954 | Ohmstede | 405/218 |
| 2,775,869 | 1/1957 | Pointer | 405/199 |
| 2,839,164 | 6/1958 | Roussel | 405/199 |
| 2,861,430 | 11/1958 | Bauer et al. | 405/201 |
| 2,920,870 | 1/1960 | Suderow | 254/93 R |
| 3,278,158 | 10/1966 | Saldana | 254/106 |
| 3,380,257 | 4/1968 | Gillman etal. | 405/221 |
| 3,568,451 | 3/1971 | Gustin | 405/221 |
| 3,570,032 | 3/1971 | Allen | 14/42 |
| 4,497,591 | 2/1985 | Gillis | 405/198 |
| 4,589,799 | 5/1986 | Hotta et al. | 405/196 |

FOREIGN PATENT DOCUMENTS

| | | |
|---|---|---|
| 209196 | 5/1960 | Austria . |
| 598528 | 5/1960 | Canada . |

*Primary Examiner*—Dennis L. Taylor
*Attorney, Agent, or Firm*—Browning, Bushman, Zamecki & Anderson

[57] ABSTRACT

Disclosed is a pier including a deck supported by an array of piles by means of flexible lines extending between the deck and elevated points on the piles. The lengths of the flexible lines extending between such points and the pier are adjustable by reels used to retract or pay out flexible line to raise or lower the deck relative to the piles. The operation of the reels may be carried out selectively or automatically in response to the changing level of the surface of the water relative to the piles. A water-motion powered motor may motivate the reel operation. The deck may be anchored against downward motion relative to the piles by locking apparatus normally engaged in a closed configuration, or by locking apparatus which is normally open and closes in response to the flexible lines going slack.

41 Claims, 12 Drawing Sheets

FIG. 10
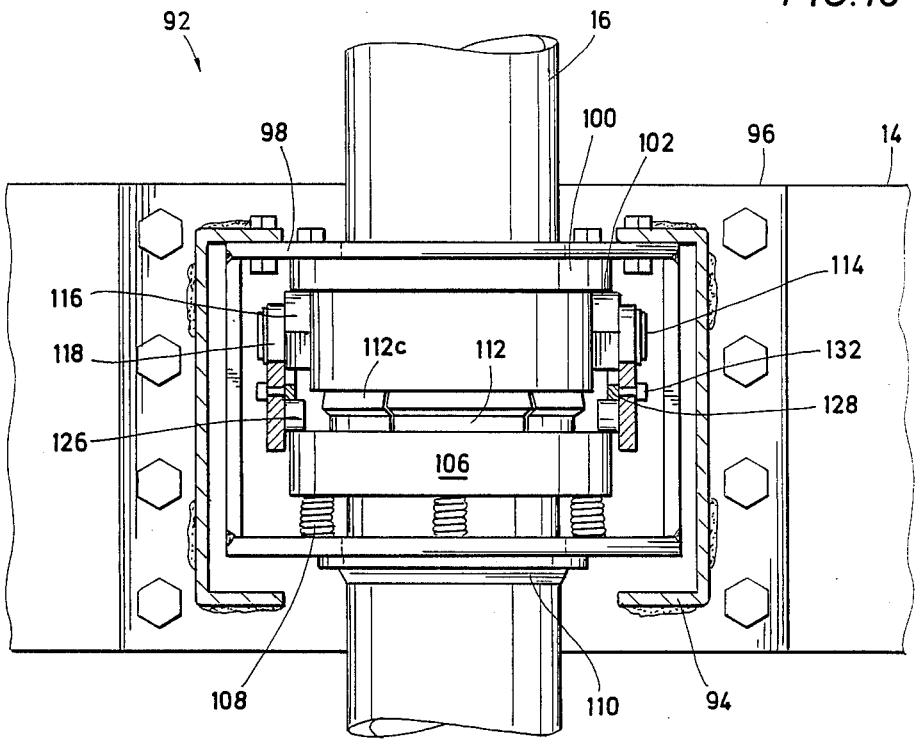
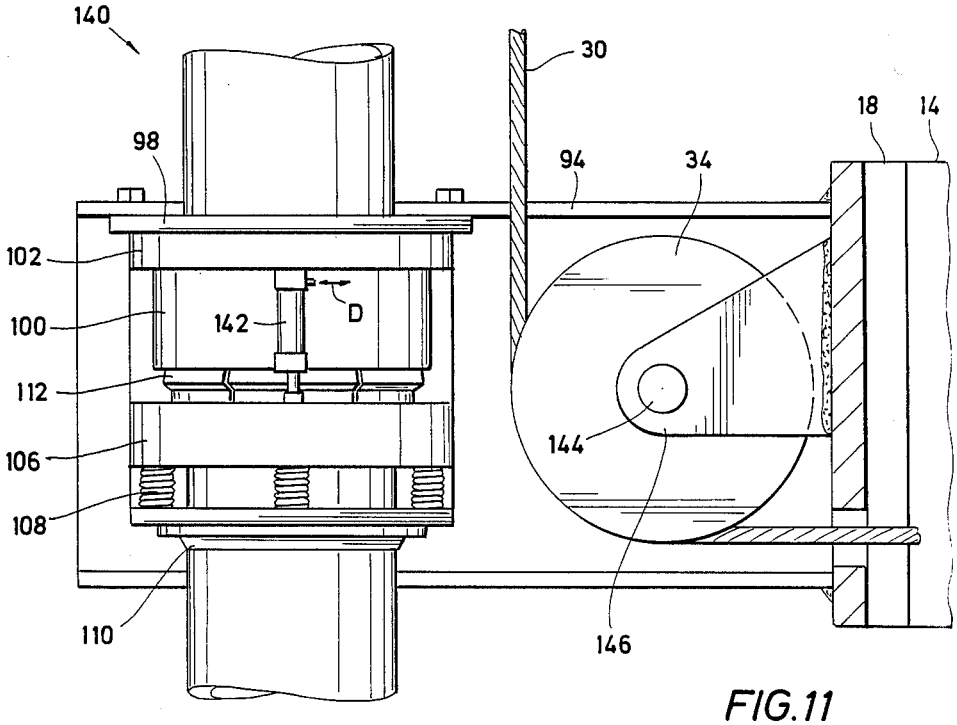
FIG. 11

FIG. 18
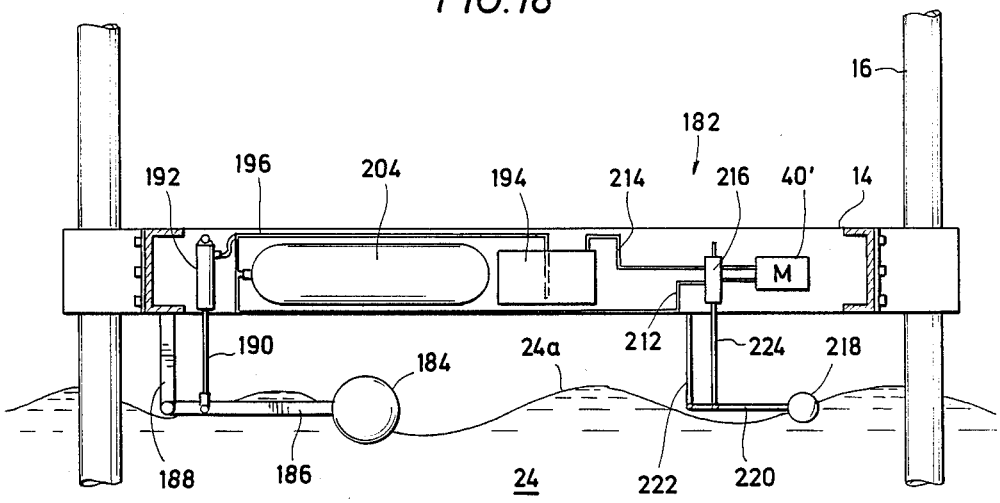
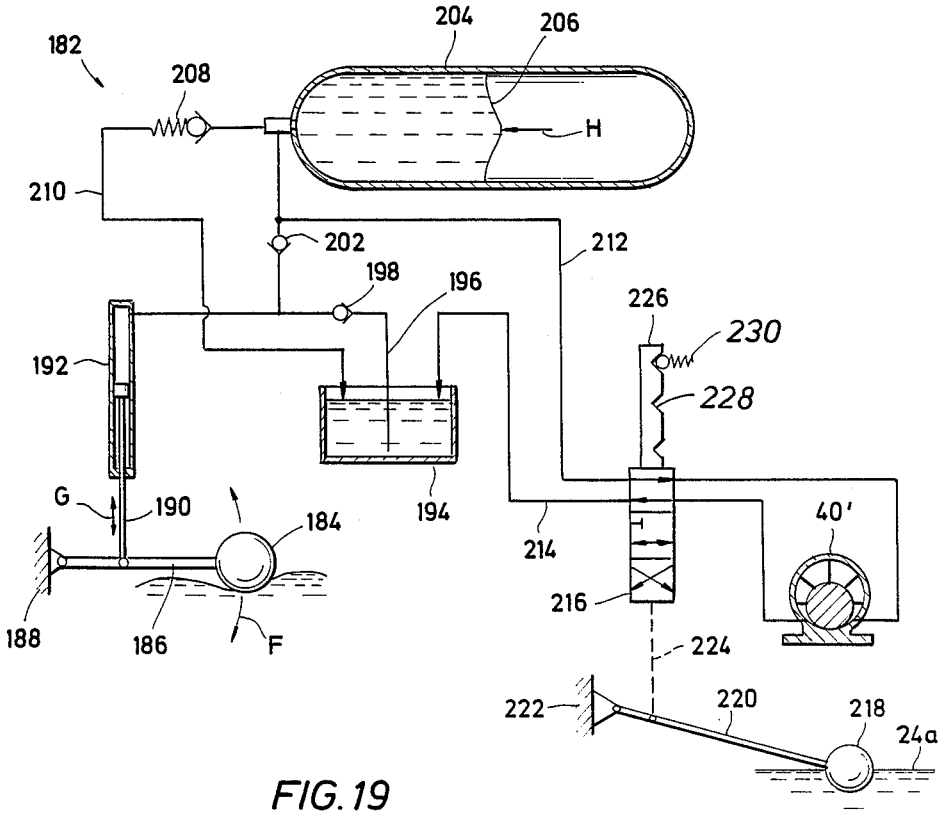
FIG. 19

FIG. 20
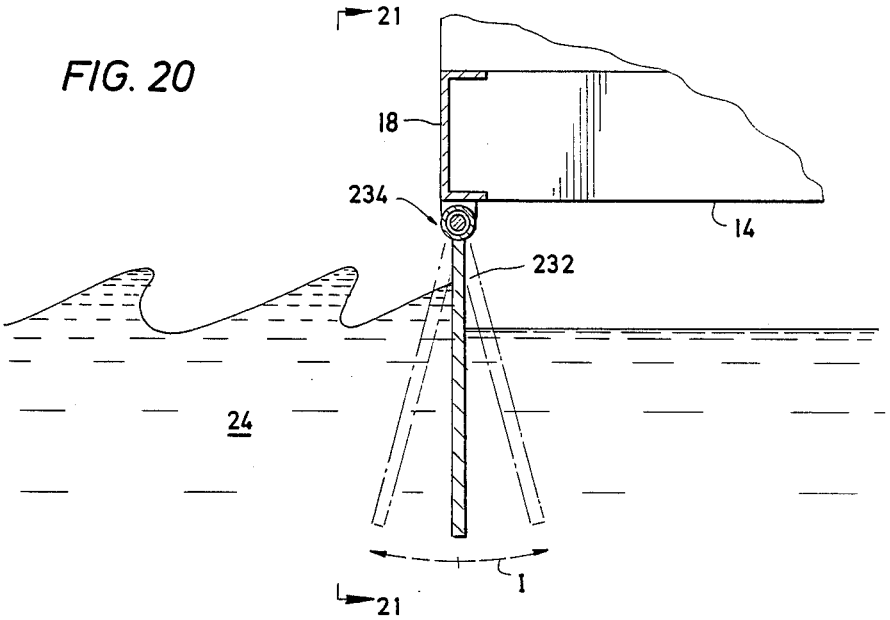
FIG. 21
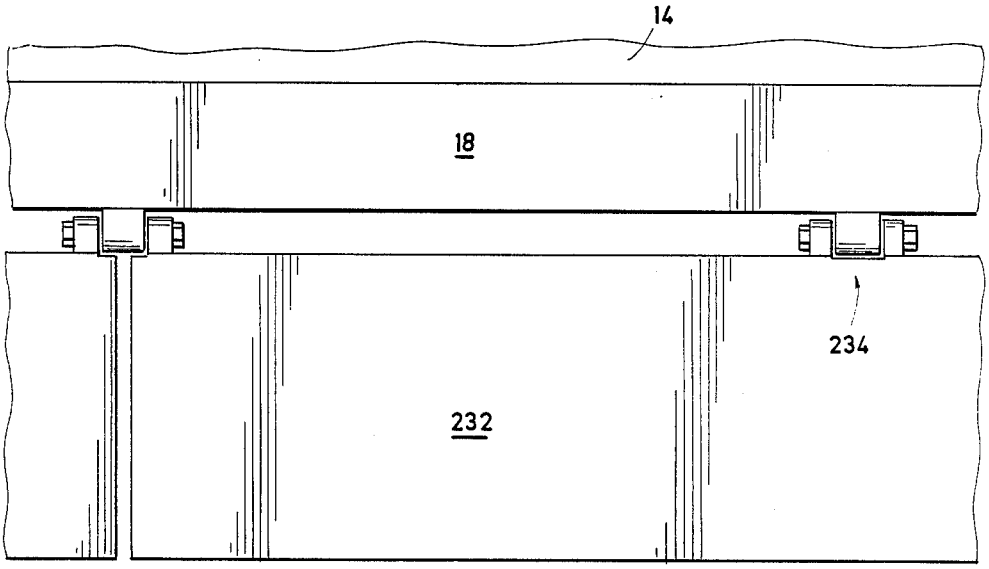
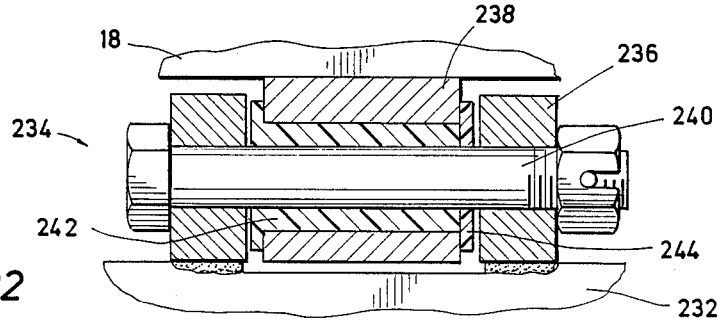
FIG. 22

FIG. 23
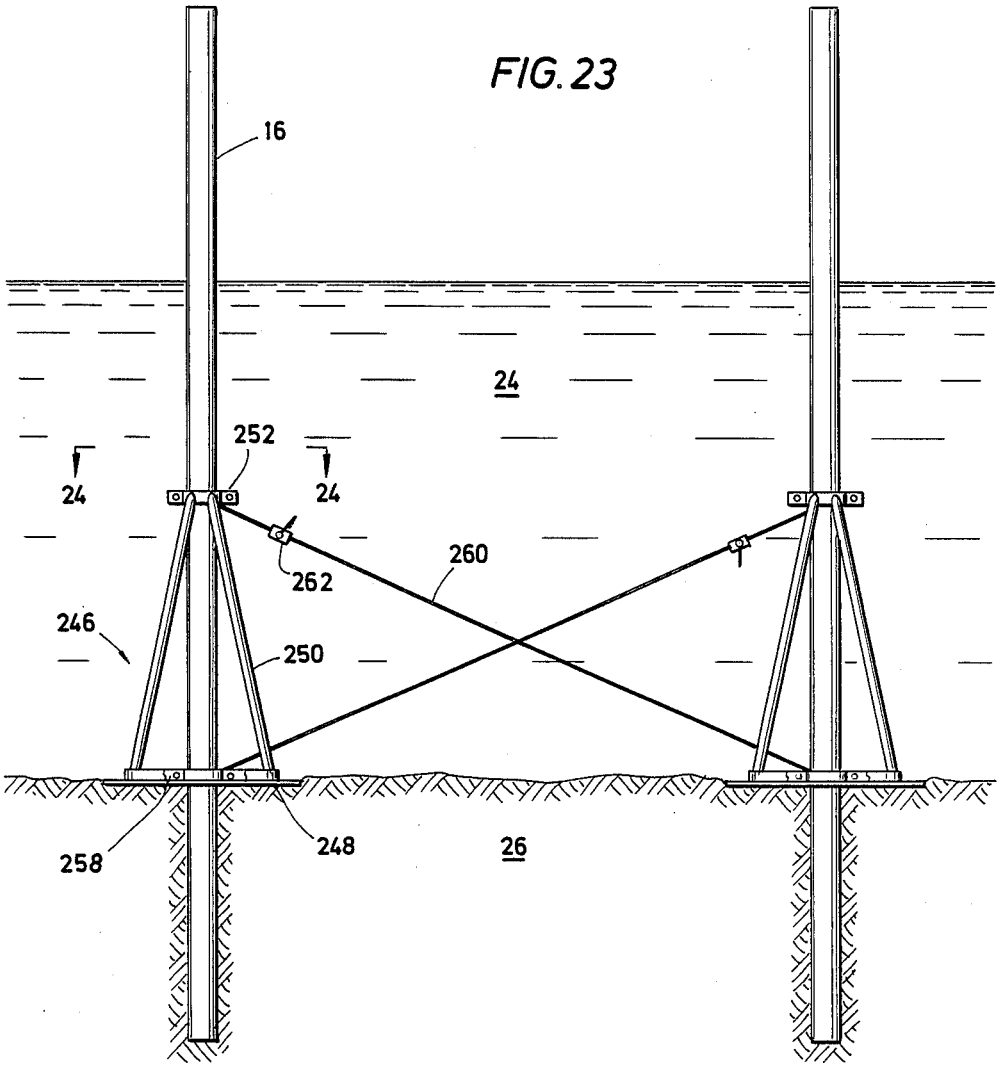
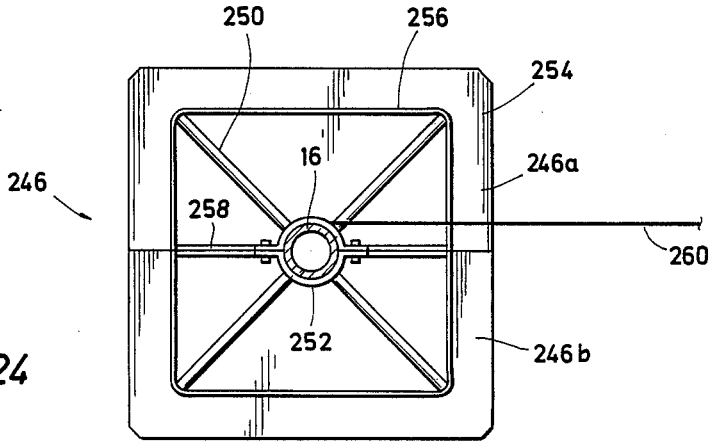
FIG. 24

METHOD AND APPARATUS FOR SELECTING AND MAINTAINING THE LEVEL OF A PIER DECK

BACKGROUND OF THE INVENTION

1. Field of the Invention

The present invention pertains to methods and apparatus for selectively adjusting and maintaining the height of an object, say, for example, for maintaining a displacement within a certain range above a rising or falling reference. More particularly, the present invention pertains to techniques for raising and lowering, as well as anchoring in position, objects such as decks, or platforms, for example, to maintain such objects a given distance, or within a given range of distances, above the rising or falling surface of a body of water. The present invention finds particular application to decks and the like to be supported over natural bodies of water.

2. Brief Description of Prior Art

Platforms and other objects such as pier decks that are used positioned above a natural body of water may be subject to large discrepancies in the level of the water with the result that the distance from the deck to the surface of the water may become extremely large as the water level falls, resulting in great inconvenience in using the pier. Similarly, in the case of rising water, the deck may be swamped and covered with the water and even damaged or destroyed.

Floating piers are known, containing sufficient buoyant devices to keep the pier floating on the surface of the body of water while constraints in the form of piles and/or lines to the shore retain the pier generally in a desired location relative to the shore while the pier rises and falls with the level of the body of water. However, a floating pier is vulnerable to wave action, which can not only damage the mechanism used to constrain the pier but also swamp and possibly destroy the pier in the case of high seas.

Other known techniques for positioning a pier or the like relative to a body of water are generally inconvenient, complicated and difficult to operate, and not designed to self-adjust in response to the rise or fall of the water surface. It is desirable to provide a technique for conveniently and readily adjusting the configuration of an object, such as a pier or the like, relative to the surface of a body of water, either selectively or in response to the change in height of the surface of the water. It is also desirable to provide a locking mechanism that may close automatically if the deck of the pier is not sufficiently supported, and that the locking mechanism is operable to close even while the deck is being raised or lowered. The present invention provides these capabilities.

SUMMARY OF THE INVENTION

The present invention provides method and apparatus for controlling the configuration of an object, such as a pier or the like, relative to a surface of a body of water. A plurality of upstanding support members, such as piles or the like, is arranged to support a deck of the pier, for example, by means of a plurality of flexible lines extending from the deck to elevated points on each of the piles. Apparatus, such as one or more reels powered by at least one appropriate motor, may be carried on the piles or by the pier for retracting or paying out the flexible lines to shorten or lengthen the length of the flexible lines extending between the deck and the elevated pile points to raise or lower, respectively, the deck relative to the piles. Where multiple reels are utilized, they may be interconnected for simultaneous operation. The motor operation may be powered by movement of the water utilizing one or more flotation devices moving under the influence of the water. Also, a sensor utilizing one or more flotation devices may control operation of the motor in response to changes in the level of the surface of the water.

The deck may be locked in anchoring engagement to the piles against at least downward movement of the deck relative to the piles. The locking apparatus may be normally closed, so locking the deck to the piles, and be selectively opened for movement of the deck relative to the piles. The locking apparatus may be normally open, that is, as long as the flexible lines extending between the deck and the elevated pile points are taut, and include a mechanism for closing the locking apparatus to provide anchoring engagement between the deck and the piles in the event of slackness in at least one of the flexible lines. The locking mechanism may comprise one or more slips and a wedging surface carried by the deck such that, in the closed, locking configuration, the wedging surface urges the slips in anchoring engagement with the pile. The locking apparatus may comprise a ratchet device.

One or more counterweights may be provided, supported by flexible lines extending over sheaves carried by one or more piles and connected to the deck for supporting at least a portion of the load provided by the deck.

Guide apparatus may be positioned on the deck, and utilized to guide and control the placement of piles relative to the seabed to so provide an appropriate array of the piles for supporting the deck.

Baffles may be suspended from the deck by hinges to engage the body of water and attenuate the wave motion of the water.

Beams, standards, or the like, may be attached to the piles to limit the extent to which the piles sink into the seabed to prevent unwanted sinking due to a soft seabed.

In a method of the invention, a deck, or the like, is suspended over a body of water by flexible lines from a plurality of piles, with the lines extending between the deck and elevated points on each of the piles. The flexible lines may be retracted or paid out, utilizing one or more reels, to adjust the length of flexible lines extending between the deck and the elevated pile points. Flotation devices may be utilized to react to the rise or fall of the surface of the body of water to control the operation of retraction or paying out of the flexible lines. The deck may be locked in anchoring engagement with the piles to prevent downward movement of the deck relative to the piles. The deck may be normally maintained in such locking engagement, and selectively disengaged from anchoring engagement for movement of the deck relative to the piles. Alternatively, the deck may be maintained movable relative to the piles with anchoring engagement occurring between the deck and the piles in response to flexible lines extending between the deck and the pile going slack.

As used herein, a pier refers to any structure positioned in or adjacent a body of water, and a deck of such a pier refers to any object supported over the body of water.

BRIEF DESCRIPTION OF THE DRAWINGS

FIG. 10 is a vertical cross section taken along line 10—10 of FIG. 6;

FIG. 11 is an enlarged side elevation in partial section of another form of locking mechanism, normally closed, for anchoring a deck relative to a pile according to the present invention;

FIG. 18 is a fragmentary, vertical cross section of a pier according to the present invention, showing the use of a flotation device responsive to movement of the water for providing motive power;

FIG. 19 is a schematic diagram of the fluid pressure circuit which may be used in the power system of FIG. 18;

FIG. 20 is an enlarged, fragmentary vertical cross section of the edge of a deck fitted with baffles to attenuate wave action under the deck;

FIG. 21 is a fragmentary side elevation taken along line 21—21 of FIG. 20;

FIG. 22 is an enlarged side elevation, in partial section, of a hinge assembly for supporting a baffle from the deck;

FIG. 23 is a side elevation, in partial section and partly broken away, of two piles, positioned in the seabed, and fitted with standards for limiting sinking of the piles into the soft seabed, and fitted with guys to straighten the piles; and FIG. 24 is a fragmentary, horizontal cross section taken along line 24—24 of FIG. 23.

DESCRIPTION OF THE PREFERRED EMBODIMENTS

Figure 1:
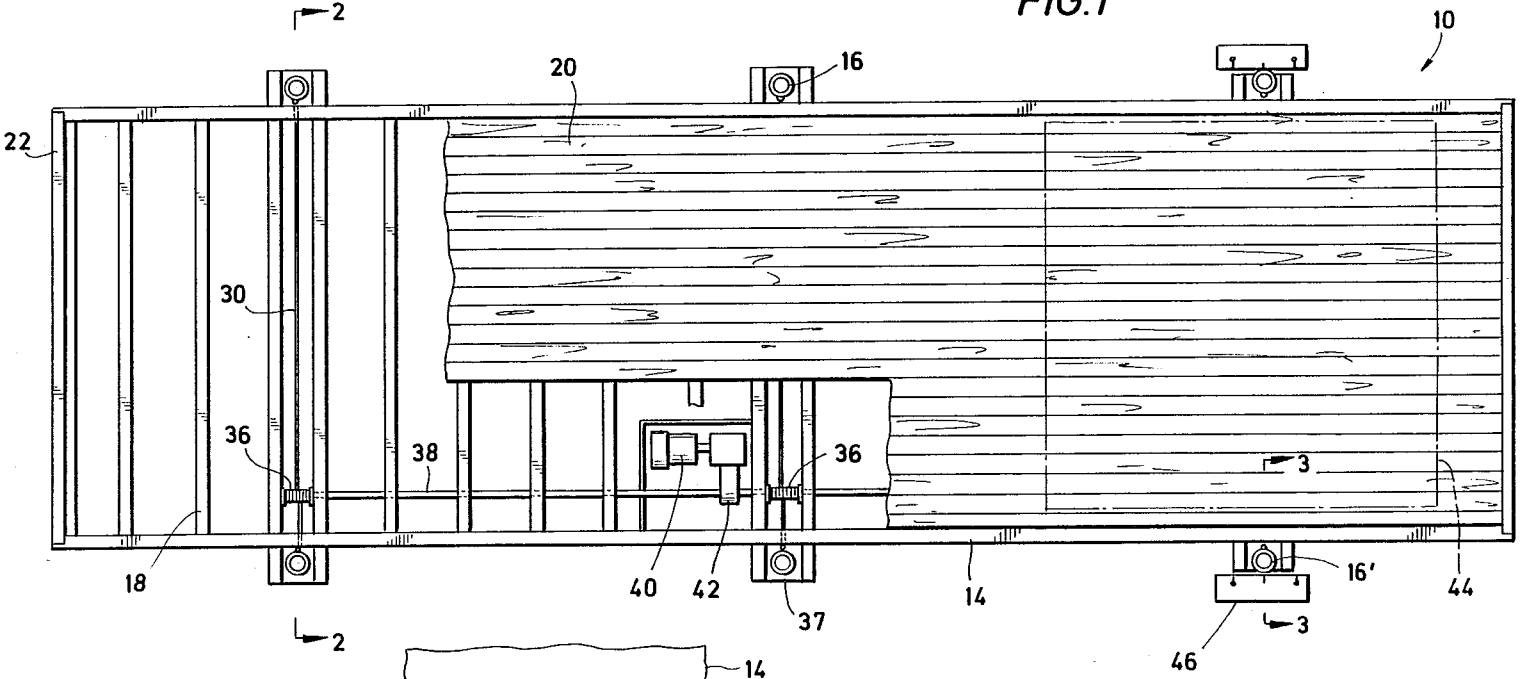
FIG. 1 is a top plan view, partially broken away, of a pier including a deck suspended from support members or piles and adjustable thereto according to the present invention.
Figure 2:
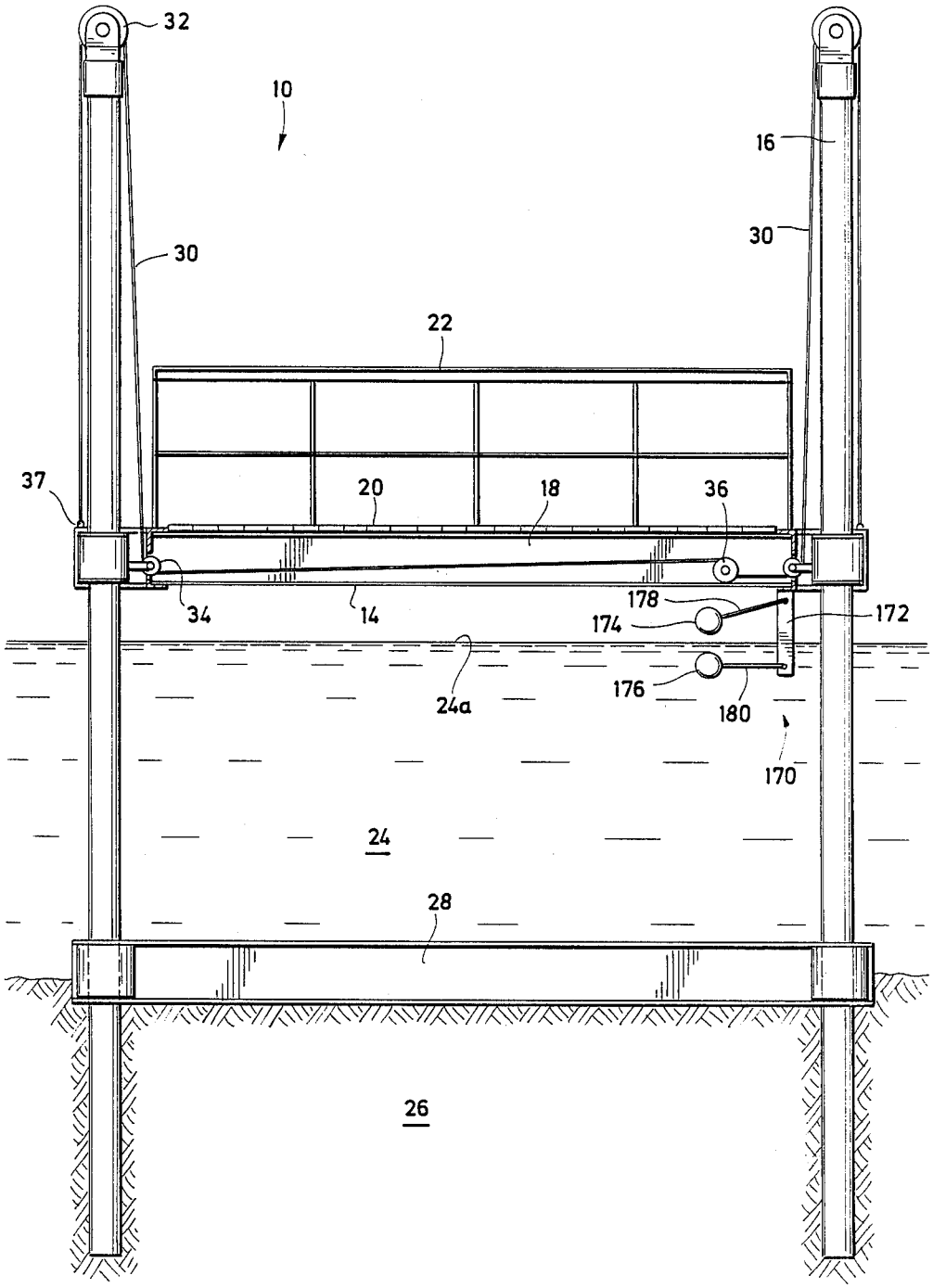
FIG. 2 is a vertical cross section of the pier taken along line 2—2 of FIG. 1, showing sensor apparatus for detecting change in the water level under the deck, and showing a beam to limit the sinking of piles into a soft seabed.

An adjustable pier according to the present invention is shown generally at 10 in FIGS. 1 and 2, and includes a deck 14 and an array of vertical supports, or piles, 16 (six are shown). The deck 14 includes a frame of horizontal members 18 and a platform, or flooring, 20 to provide a working surface. Railings 22 may be added as needed or desired to provide the usual constraint and safety feature.

As may be appreciated by reference to FIG. 2, the piles 16 extend downwardly through a body of water 24 and into the seabed 26 below the water. Framework comprising one or more cross beams 28 may be provided, attached to the piles 16 at the surface of the seabed 26 to limit the sinking of the piles in a relatively soft seabed.

The deck 14 is suspended by a plurality of flexible lines 30, such as cables, chains, ropes, or the like, extending between freely rotatable sheaves 32 at elevated points on the piles and the platform, with the flexible lines passing around appropriate freely rotatable sheaves 34 carried by the platform and ending at reels, or drums, 36. The reels 36 store excess line 30, and are rotatable to retract or pay out flexible line to raise or lower, respectively, the platform relative to the piles 16. As illustrated, flexible lines 30 extend from each of two oppositely positioned piles 16 and are wound about a single reel 36 in the same rotational sense so that rotation of the reel to retract one of the flexible lines, for example, simultaneously retracts the other flexible line and at the same rate. Paying out the flexible lines 30 occurs also simultaneously as the sense of rotation of the reel is reversed. Toward their opposite ends, the lines 30 pass over the pile sheaves 32 and are anchored at points 37 on extensions of the deck frame 18 to halve the load on each length of line.

For the three pairs of oppositely positioned piles 16, three reels 36 are provided to accommodate and control the six flexible lines 30. Each of the reels 36 is mounted on a rotatable shaft 38 carried along the deck framework 18 and connected to a motor 40 by an appropriate gear box 42. Operation of the motor 40 in one rotational sense or the other results in rotation of the reels 36 to retract or pay out the flexible lines 30. Thus, selective operation of the motor 40 results in the raising or lowering of the deck 14 relative to the piles 16.

It will be appreciated that downward movement of the deck 14 relative to the piles 16 also occurs under the influence of gravity so that operation of the motor 40 through the gear box 42 may slow the descent of the pier while allowing such descent to occur. If needed, an appropriate breaking mechanism may be incorporated, such as within the gear box assembly 42, for example, to so control the descent of the deck 14. Appropriate anchoring apparatus for use in holding the deck 14 against downward movement is described in detail hereinbelow.

Turnbuckles or the like (not shown) may be added to each segment of the flexible lines 30 to adjust the initial tension in each of the lines and to make subsequent tension adjustments from time to time as necessary, particularly in view of the fact that the different flexible line segments may be under different amounts of stress, or stretch at different rates.

In FIG. 1, an additional structure is indicated generally in phantom at 44. Such a structure might be a shed or boat storage facility, etc. mounted on the platform. In such case, the total load of the platform 20 would be distributed unevenly across the length of the deck 14 and, therefore, on the flexible lines 30 and the reels 36. To overcome such an imbalance, counterweights may be utilized in the vicinity of the extra load.

Figure 5:
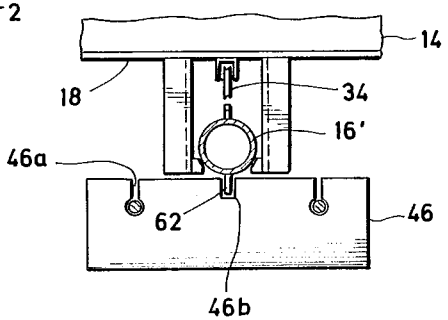
FIG. 5 is an enlarged horizontal cross section taken along line 5—5 of FIG. 4.
Figure 3:
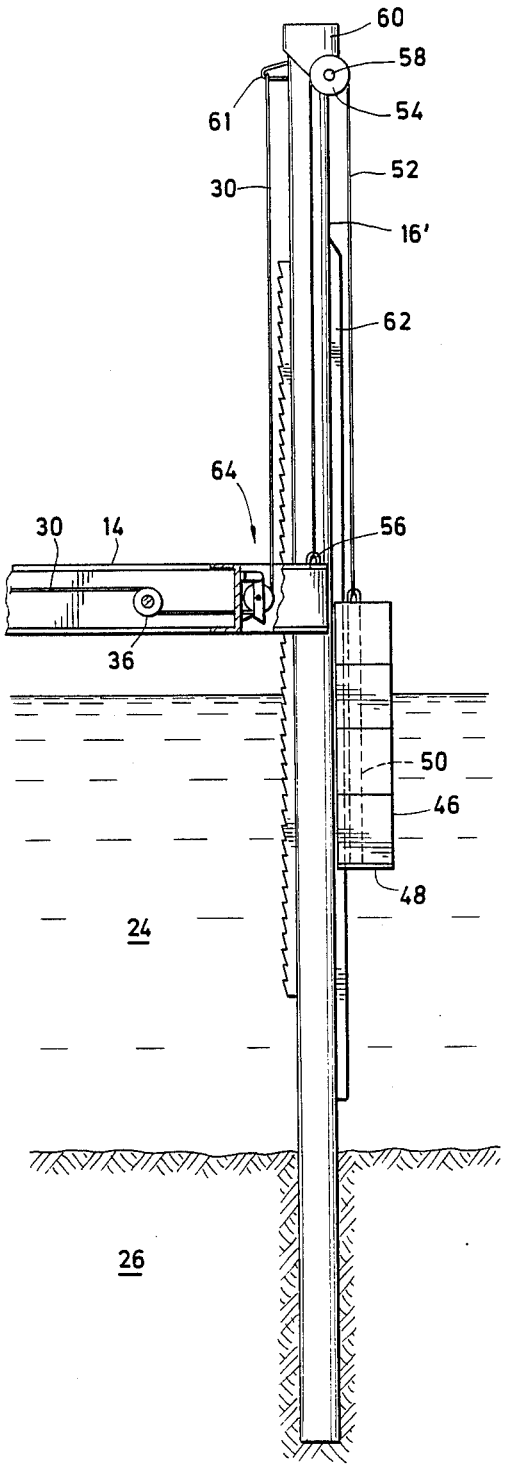
FIG. 3 is an enlarged fragmentary view, in partial section, taken along line 3—3 of FIG. 1, showing a pile supporting a counterweight.
Figure 4:
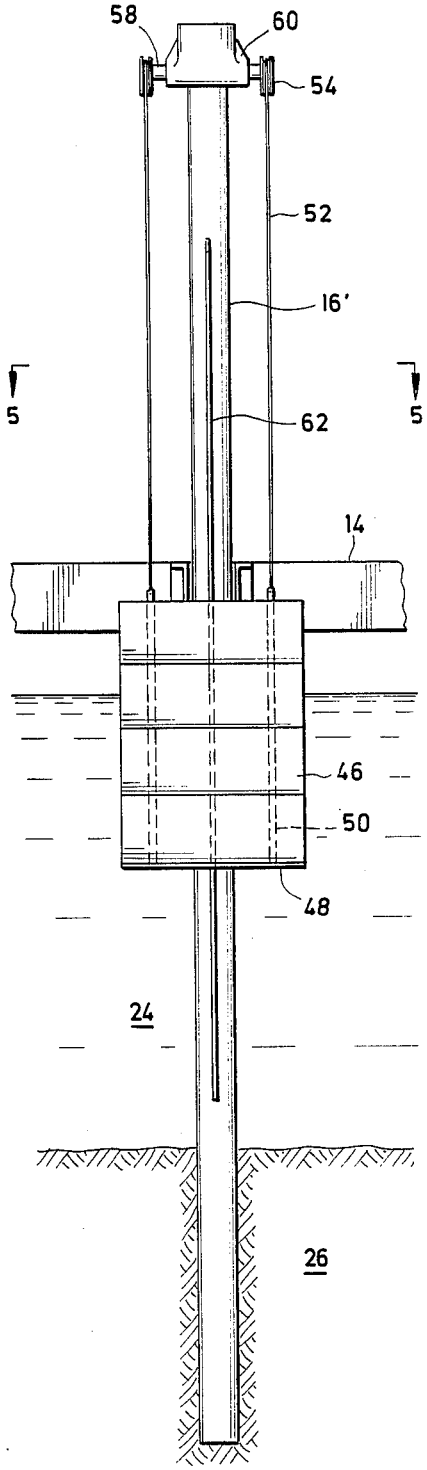
FIG. 4 is a fragmentary side elevation showing the pile and counterweight of FIG. 3.

As shown in FIGS. 1, 3 and 4, the piles 16' in the vicinity of the extra load 44 are fitted with counterweights 46. Such counterweights 46 may be constructed, for example, utilizing a base 48 from which two rods 50 extend so that individual blocks of weight may be stacked on the base 48 and receive the rods 50 in appropriate slots **46*a* (see FIG. 5). A flexible line 52 is connected to the top of each rod 50 and extends upwardly over an appropriate sheave 54 and down to an anchoring position 56 on the deck 14 to halve the load on the line. The sheaves 54 are mounted on appropriate axles 58 carried by a cap 60 on the top of the pile 16'. Consequently, a portion of the load of the deck 14, including any structure carried thereon, is balanced by the counterweights 46, which rise or fall with the flexible line 52 passing over the rotatable, free-wheeling sheaves 54 as the deck 14 is made to rise or fall in response to operation of the motor 40**.

Further, since part of the load of the deck 14 is supported by the counterweight 46 by means of the line 52, the line 30 to the reel 36 may end at an elevated anchoring point 61 on the pile 16 rather than passing over a sheave 32 (FIG. 2) and doubling back down to the deck frame to halve the load on the reel line 30. It will be appreciated, however, that the support line 30 may be doubled over a pile sheave 32 in conjunction wtih a counterweight 46 supported on the same pile 16.

While the counterweights 46 are free to rise and fall opposite to the motion of the deck 14, the counterweights may be at the surface of the body of water 24, or below. To limit or prevent unwanted lateral movement of the counterweights 46 due to currents or wave action, for example, a rail 62 is welded along the pile 16' and received within an appropriate slot **46*b* (see FIG. 5) in the counterweight structure. It will be appreciated by reference to FIGS. 1 and 3–5 that the counterweight 46 rides along its corresponding rail 62**, which tends to constrain the counterweight against undesirable lateral movement.

Although two counterweights 46 have been discussed and are illustrated in connection with a structural load 44, it will be appreciated that counterweights may be utilized at additional piles 16, and even with piles (not shown) which do not incorporate flexible lines 30 for raising and lowering the deck 14. The actual weight of counterweights 46 thus distributed about the deck 14 on the array of piles 16 may be varied from counterweight to counterweight to correspond to the distribution of the load of the deck and any additional structures or loads carried by the deck. Thus, counterweights 46 may be utilized to lighten the load that must be supported by the flexible lines 30 used to raise, lower and generally support the deck 14 by the additional support provided by the counterweights 46 connected to the deck 14 by the flexible lines 52.

Figure 12:
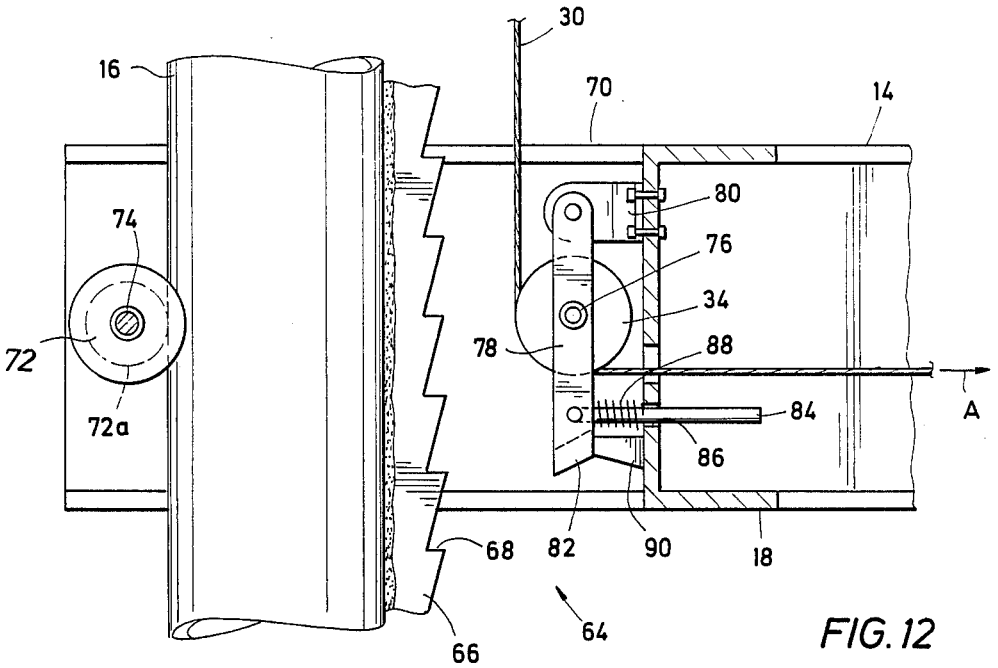
FIG. 12 is an enlarged side elevation in partial section of yet another form of locking mechanism, normally open, for anchoring a deck relative to a pile according to the present invention.
Figure 13:
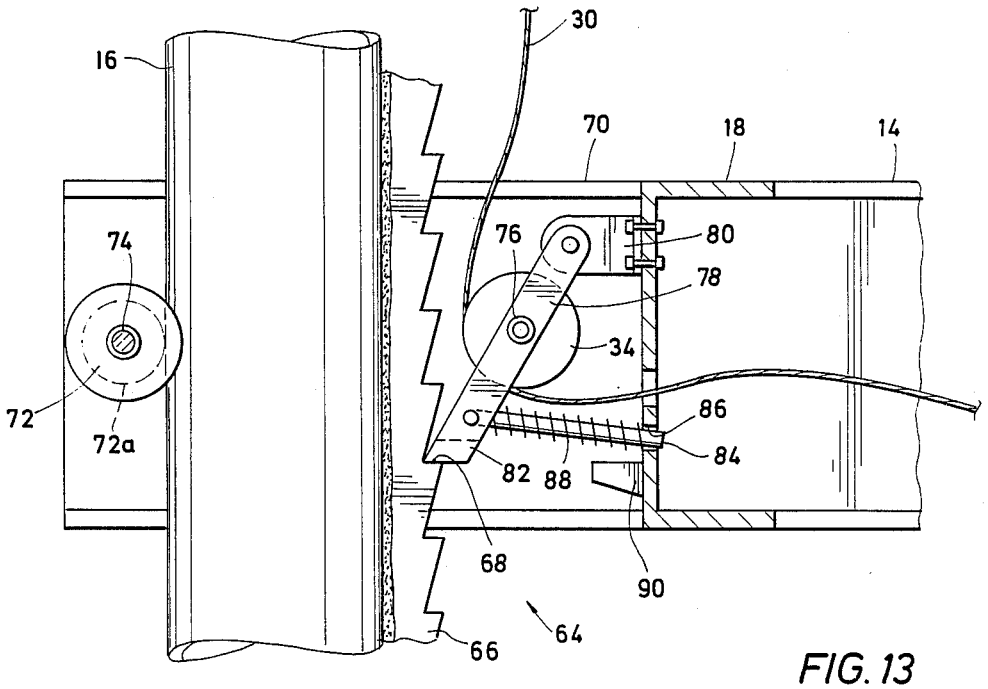
FIG. 13 is a view similar to FIG. 12, but illustrating the locking mechanism of FIG. 12 in anchoring engagement in response to slack in the associated flexible support line.

A positive locking device is shown generally at 64 in FIG. 3, and illustrated in more detail in FIGS. 12 and 13. A ratchet in the form of a saw tooth, elongate bar 66 having horizontal landing surfaces 68 is welded along the pile 16 facing the deck 14. The framework 18 of the deck 14 extends beyond the general periphery of the deck in a box, or beam extensions, 70, so that the pile 16 is at least partially surrounded. A wheel 72 is carried freely rotatable on an axle 74 positioned perpendicular to the longitudinal axis of the pile 16 and on the outside of the pile opposite the deck 14, the axle being carried by the beam extensions 70. The wheel 72 features a groove **72*a* which receives the curved surface of the pile 16 to constrain the deck 14 from moving away from the pile beyond a certain distance, as illustrated in FIGS. 12 and 13**.

The sheave 34 about which the flexible line 30 passes from the elevated sheave 32 on the pile 16 to the corresponding reel 36, indicated by arrow A, is mounted on an axle 76 carried by a lever 78 which is pivotally connected to a bracket 80, bolted to the deck framework 18 and providing the fulcrum for the lever. To accommodate the sheave 34 and for added strength, the lever 78 is in the form of a fork whose tines are positioned on opposite sides of the sheave 34 and the bracket 80, but which has a solid end 82.

In FIG. 12, the flexible line 30 is taut, indicating that the flexible line and the pile 16 are supporting at least a portion of the load of the deck 14, and the latter may either be in the process of being raised or lowered, or being held stationary by the reels 36 under the influence of the motor 40. A plunger 84 is pivotally connected to the lever 78 and extends through an appropriate hole 86 in the frame member 18. A coil spring 88 surrounds and is carried by the plunger 84 between the lever and the frame member 18. A post 90 extends from the frame member 18 and receives the lever end 82 in the configuration of FIG. 12 wherein the taut flexible line 30 urges the sheave 34 generally toward the right and upwardly, as viewed in FIG. 12. This urging of the sheave 34 by the taut flexible line 30 tends to rotate the lever 78 clockwise as viewed in FIG. 12, forcing the lever to the right against the post 90. In this configuration of the lever 78, the plunger 84 extends a substantial distance through the frame hole 86, and the coil spring 88 is substantially compressed between the lever and the frame member 18, tending to urge the lever away from the post 90.

As long as the flexible line 30 remains taut, the lever 78 will be held against the post 90 and prevented from rotating clockwise toward the ratchet 66 under the influence of the spring 88. This is the normal, open configuration of the locking mechanism 64, which provides no interference to movement of the deck 14 up or down relative to the pile 16. In the event the flexible line 30 becomes slack, as shown in FIG. 13, due to a break in the line, the line becoming disengaged, the corresponding reel 36 breaking loose, or some other cause resulting in the line no longer supporting the deck 14, the locking mechanism 64 will activate to close to prevent downward movement of the deck relative to the pile 16.

As shown in FIG. 13, slack in the line 30 allows the compressed coil spring 88 to expand, driving the lever 78 clockwise so that the solid lever end 82 moves onto a ratchet landing surface 68 and serves as a pawl to prevent the deck 14 carrying the lever 78 from moving downwardly relative to the ratchet 66 which is fixed to the pile 16. The plunger 84 is sufficiently long to retain the spring 88 in position between the frame member 18 and the lever 78 to drive the lever end 82 onto the landing surface 68 and maintain that configuration of the lever to hold the locking mechanism 64 in the configuration to provide anchoring engagement between the deck 14 and the pile 16.

Once the condition that resulted in the flexible line 30 becoming slack has been corrected, for example, the locking mechanism 64 may be released after the flexible line 30 is tightened, by rotation of the reel 36, for example. As the reel 36 is further operated to retract the flexible line 30, the force applied to the sheave 34 by the tightened flexible line 30 urges the sheave and the lever 78 to swing counterclockwise as viewed in FIG. 13 toward the open configuration illustrated in FIG. 12. If necessary, the reel 36 may be operated to retract the line 30 to raise the deck 14 slightly relative to the pile 16 so that the closed end 82 of the lever 78 may be lifted off of and clear the landing surface 68, after which the lever is swung against the post 90 and the spring 88 compressed as shown in FIG. 12, with the flexible line 30 now supporting the deck 14.

Another version of a normally open locking mechanism is shown generally at 92 in FIGS. 6–10. A mounting frame 94 comprises two mutually-facing channel beams welded to an end plate 96 by which the frame is bolted to a deck frame member 18. A generally rectangular housing 98 is bolted to the top flanges of the mounting frame channel beams 94, is openended toward and away from the deck 14, and loosely surrounds the pile 16. A first, or upper, ring 100 is bolted to the underside of the housing 98 and also surrounds the pile 16. The ring 100 features an annular, downwardly-facing frustoconical surface 104.

A second, lower ring 106 loosely surrounds the pile 16 below the first ring 100, and cooperates with the bottom of the frame 98 to constrain a plurality of coil springs 108 constrained in appropriate detents in the mutually-facing surfaces of the second ring 106 and the bottom of the housing 98. The coil springs 108 urge the second ring 106 upwardly relative to the housing 98 and generally toward the upper ring 100.

Figure 7:
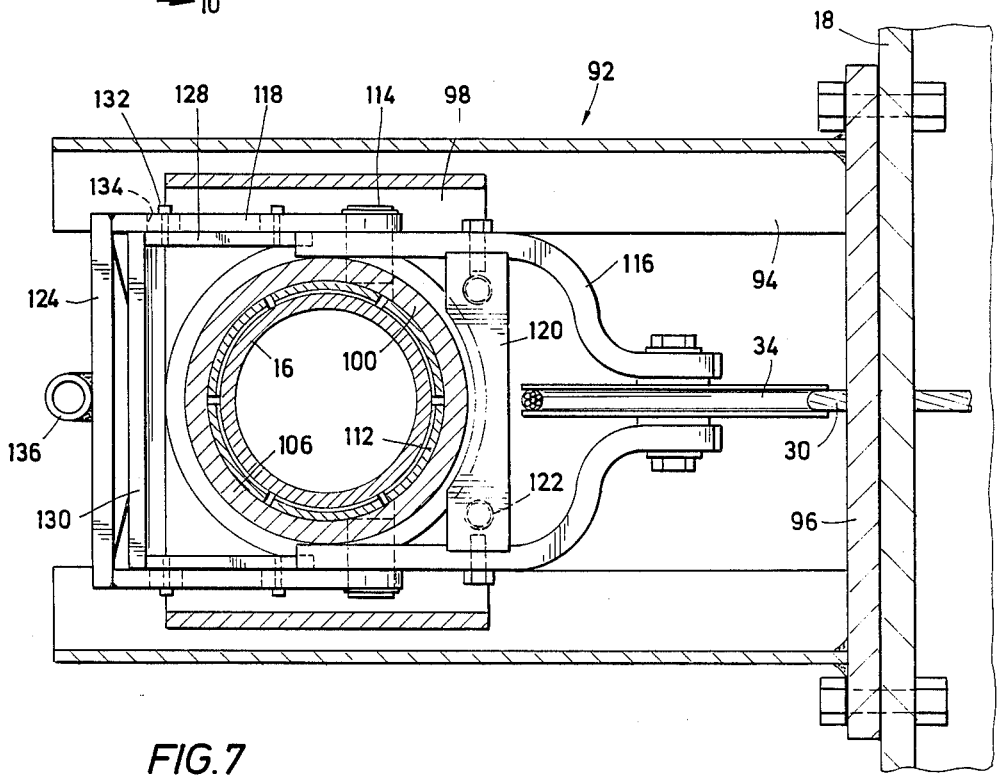
FIG. 7 is a horizontal cross section taken along line 7—7 of FIG. 6.

A scraper ring 110 is attached to the underside of the bottom of the housing 98, and, except for a split in the ring, circles the pile 16. The lower edge of the split scraper ring 110 is urged against the pile 16 so that, as the deck 14 moves downwardly relative to the pile, the scraper ring scrapes any accumulated dirt or organic growth from the pile to keep it cleand while the split allows the ring to expand and spring back to accommodate the irregularities in the pile's surface. A plurality of slips 112 (six are shown in FIG. 7) are arranged to generally circumscribe the pile 16 and are constrained by an inwardly-directed annular shoulder 106*a* of the second ring 100, overlying an inwardly-facing annular groove 106*b* of the ring which receives a generally complementary, outwardly-facing arcuate flange 112*a* at the bottom of each slip. Thus, as the ring 106 rises or falls relative to the housing 98 and the top ring 100, the slips 112 move upwardly or downwardly, respectively, relative to the top ring as well.

Figure 6:
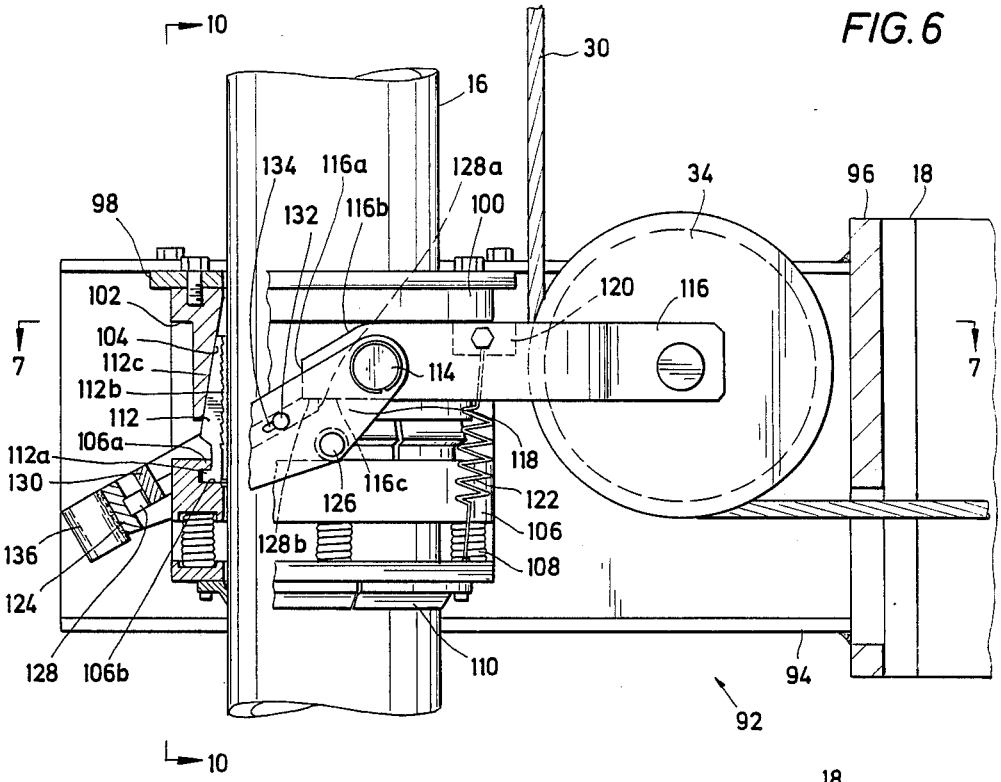
FIG. 6 is an enlarged side elevation of a locking mechanism for constraining movement of the deck relative to a pile, with the locking mechanism in its normally-open configuration.
Figure 8:
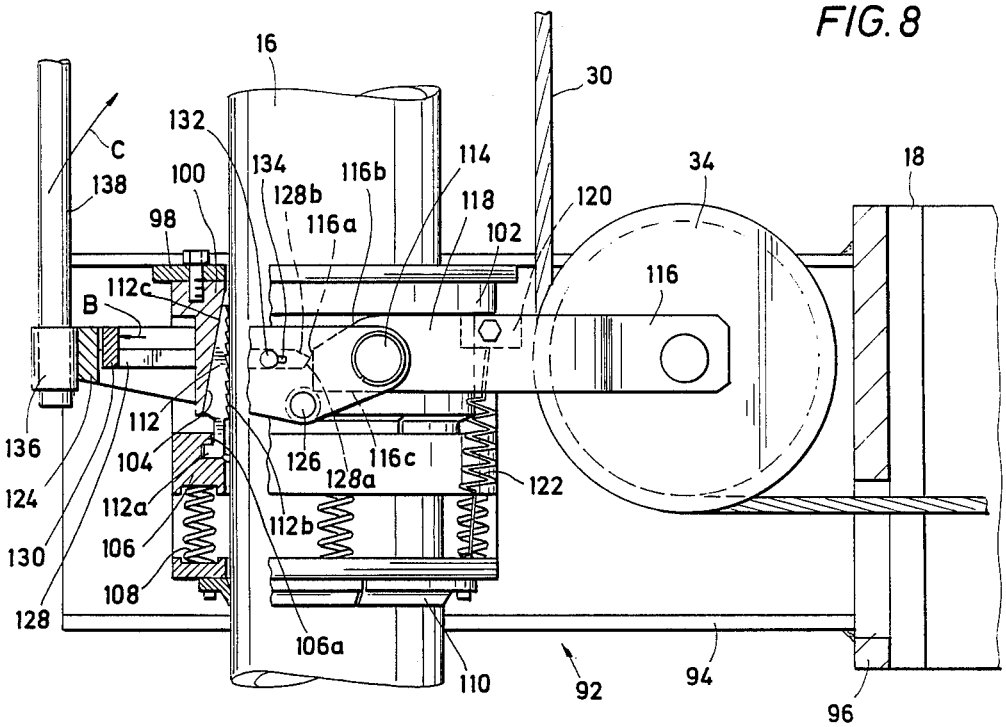
FIG. 8 is a view similar to FIG. 6, but showing the locking mechanism moved to anchoring engagement by means of an added handle.
Figure 9:
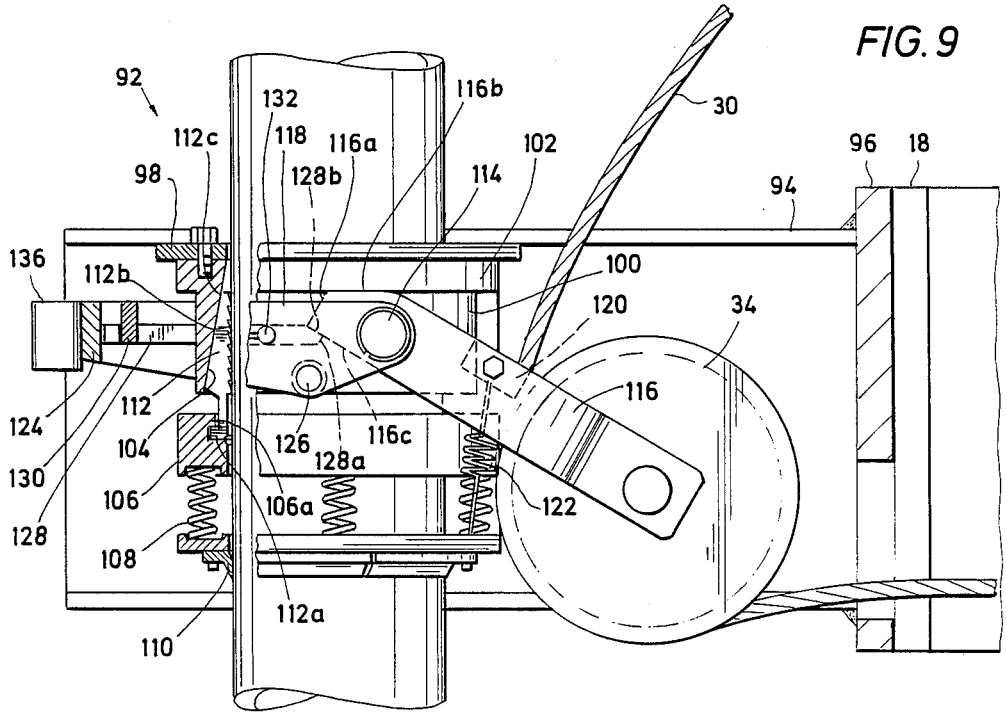
FIG. 9 is a view similar to FIGS. 6 and 8, but showing the locking mechanism moved to anchoring engagement by means of slack in the associated flexible support line.

Each slip 112 features an inner surface facing the pile 16 lined with horizontal, arcuate, downwardly-facing gripping edges 112*b*, and an outer surface 112*c* that is a fragment of a frustoconical structure which is generally complementary to the frustoconical inner surface 104 of the top ring 100. With the second ring 106 in a lower configuration as illustrated in FIGS. 6, 7 and 10, wherein the coil springs 108 are compressed, the slips 112 are sufficiently withdrawn relative to the top ring inner surface 104 to allow the slips to fit generally loosely between the top ring 100 and the pile so that the slips and the deck 14 may move freely along the pile. In FIGS. 8 and 9, the second ring 106 is shown elevated relative to the top ring 100, with the coil springs 108 somewhat extended, whereby the slips 112 are driven upwardly relative to the top ring whose inner frustoconical surface 104 cooperates with the outer surface 112*c* of each slip to wedge the slips against the pile 16 so that the slip gripping edges 112*b* tend to "bite" against the pile and maintain the deck 14 in gripping engagement with the pile to prevent downward movement of the deck relative to the pile.

The upper ring 100 receives, in appropriately threaded bores, two opposed pivot pins 114 about which two yokes 116 and 118, respectively, may pivot. One yoke 116 located generally toward the deck 14 comprises two curved arms joined together by a pivot pin assembly which serves as an axle for the sheave 34 about which the flexible line 30 is wrapped between the elevated pile sheave 32 and the corresponding reel 36. A stop member 120 is bolted across the interior of the yoke 116 and features a recess to allow the stop member to fit around the lower shank of the upper ring 100 and to rest against the underside of the upper ring shoulder 102 to prevent the yoke from rotating about the pivot pins 114 counterclockwise from the configuration illustrated in FIGS. 6–8. Thus, the yoke 116 carrying the sheave 34 is held in place as shown in FIGS. 6–8, with the stop 122 against the ring shoulder 102, by the tension in the flexible line 30 supporting the deck 14 from the elevated pile sheave and urging the sheave 34 upwardly and to the right and the yoke 116 generally counterclockwise. This operating configuration of the yoke 116 as illustrated in FIGS. 6–8, with the stop 120 against the shoulder 102, is maintained as long as the flexible line 30 is taut, even with the deck 14 being raised or lowered relative to the pile 16.

A coil spring 122 is extended under tension between each arm of the yoke 116 and the base of the housing 98. The springs 122 generally urge the yoke 116 downward and clockwise, in the open configuration, as viewed in FIG. 6, against the urging by the taut support line 30.

The second yoke 118 comprises two arms carried by the pivot pins 114 but extending generally away from the deck 14 and joined at the rear by a cross bar 124. Rollers 126 are carried on opposite sides by the second yoke 118 to reside on and ride along the top surface of the second collar 106, retaining that collar in a lower configuration as shown in FIGS. 6, 7 and 10 with the springs 108 compressed and the slips 112 withdrawn from anchoring engagement with the pile 16.

The second yoke 118 carries a third yoke 128, including two arms carried on the inside of each of the side arms of the second yoke and a cross bar 130 joining the ends of the two inner yoke arms. A pin or the like 132 is carried by each of the arms of the inner yoke 128 and extends through a corresponding slot 134 running generally longitudinally along the respective side arm of the second yoke 118. Thus, the inner yoke 128 may slide a short distance along the outer, second yoke 118, limited by the pins 132 moving within the slots 134.

The end of each side member of the yoke 116, extending generally away from the platform 14, has a transverse flat surface 116*a* and a beveled upper surface 116*b* forming angles with the flat bottom surface 116*c*. The end of each side member of the inner yoke 128, extending generally toward the platform 14, has a lower beveled surface 128*a* and an upper beveled surface 128*b*.

In the open configuration illustrated in FIGS. 6, 7 and 10, wherein the first yoke 116 is horizontal and the second yoke 118 is oriented angled downwardly relative to the first yoke, the inner yoke 128 is extended toward the first yoke 116 limited by the pins 132 within the slots 134, and the inner yoke upper beveled surfaces 128*b* reside against the first yoke lower surfaces 116*c*, respectively. Then, the second yoke rollers 126 press downwardly on the second ring 106 to maintain the coil springs 108 compressed, and the slips 112 withdrawn downwardly away from anchoring engagement with the pile 16. As long as the flexible line 30 is maintained taut to hold the first yoke 116 in the horizontal configuration, with the stop 120 against the first ring shoulder 102, as illustrated in FIGS. 6, 7 and 10, the position of the inner yoke surfaces 128*b* against the bottom surfaces 116*c* of the first yoke will cooperate with the horizontal orientation of the first yoke 116 to retain the second yoke 128 so tilted with the rollers 126 contacting and holding the second ring 106 in its lower configuration with the slips 112 withdrawn downwardly out of anchoring engagement with the pile 16, against the forces generated by the compressed springs 108 urging the second ring upwardly. In this configuration illustrated in FIGS. 6, 7 and 10, the deck 14 is thus free to be raised or lowered along the pile 16, and is held in place by the use of the flexible lines 30.

Operation of the locking mechanism 92 as a safety lock may be appreciated by reference to FIG. 9, wherein the flexible line 30 is shown slack. Such a condition may have occurred, for example, by the line 30 breaking, becoming disengaged at one end or the other, its reel 36 having come loose or broken, the sheave 32 at the top of the pile 16 to which the line 30 is anchored having broken, or some other reason. In any event, the line 30 is slack and no longer able to support the deck 14. Then, the first yoke 116, carrying the sheave 34, is relatively free to rotate clockwise about the pivot pins 114, as illustrated in FIG. 9, and does so rapidly under the influence of the tension springs 122 pulling the yoke 116 generally downwardly. The second yoke 118 pivots clockwise about the pivot pins 114 with the first yoke 116, with the inner yoke 128 remaining fixed relative to the second yoke 118, and the upper beveled yoke arm end surfaces 128*b* residing against the lower end surfaces 116*c* of the first yoke, until the upper beveled end surfaces 116*b* of the first yoke rest aqainst the undersurface of the first ring shoulder 102 as illustrated. This rotation of the yokes 116 and 118 raises the rollers 126 sufficiently to permit the second ring 106 to be driven upwardly by the coil springs 108, forcing the slips 112 against the frustoconical surface 104 of the upper ring 100. In this way, the slips are wedged against the pile 16 by the upper ring surface 104, and the gripping edges 112*b* make anchoring engagement with the surface of the pile 16 to prevent downward movement of the locking mechanism 92 and, therefore, the deck 14 relative to the pile 16.

While the anchoring engagement between the deck 14 and the pile 16 effected by the locking mechanism 92 in the anchoring configuration illustrated in FIG. 9 prevents downward movement of the deck relative to the pile, the deck may be raised along the pile, by operation of other flexible lines 30, for example, with the locking mechanism remaining in anchoring engagement as illustrated in FIG. 9, accompanied by the gripping edges 112*b* of the slips 112 sliding upwardly along the surface of the pile.

The anchoring engagement of the locking mechanism 92 as illustrated in FIG. 9 may be released by tightening the corresponding flexible line 30 to draw the sheave 34 upwardly and to the right to cause the yoke 116 to rotate counterclockwise as viewed in FIG. 9. Such rotation of the first yoke 116 is accompanied by rotation of the second yoke 118 due to the positioning of the inner yoke end surfaces 128*b* against the bottom end surfaces 116*c* of the first yoke. As the yoke rotations proceed, the rollers 126 engage the top surface of the second ring 108 and drive the second ring downwardly as the yokes continue to rotate. Thus, as the flexible line 30 is tightened to support the deck 14, the second ring 106 is driven downwardly to compress the springs 108 and withdraw the slips 112 downwardly, with the inner ring shoulder 106*a* pulling on the slip flnages 112*a*, to release the slips from being wedged in anchoring engagement by the first ring frustoconical surface 104. Then, with the line 30 taut, the locking mechanism 92 has been returned to the open configuration illustrated in FIGS. 6, 7 and 10.

It may be desirable or necessary to selectively activate the locking mechanism 92 to anchor the deck 14 against downward movement relative to the pile 16. To facilitate such activation, the back cross member 124 of the second yoke 118 is fitted with a ring 136 which may receive a handle 138 (FIG. 8) for ease in manipulation of the second yoke. Starting with the configuration shown in FIGS. 6, 7 and 10, the inner yoke 128 may be withdrawn by pulling on its back cross member 130 as indicated by arrow B in FIG. 8, sliding the pins 132 along the slots 134 until the beveled end surfaces 128*b* clear the end of the lower surfaces 116*c* of the first yoke 116. Then, the second yoke 118 is free to be rotated clockwise on the pivot pins 114, as indicated by arrow C in FIG. 8, while the first yoke 116 remains horizontal with its stop 122 against the undersurface of the first ring shoulder 102, held in that position by the taut flexible line 30. The inner yoke 138 clears the back surface 116a of the first yoke 116 in the configuration achieved in FIG. 8.

The clockwise rotation of the second yoke 118 lifts the rollers 126, allowing the springs 108 to drive the second ring 106 upwardly, forcing the slips 112 within the frustoconical surface 104 of the upper ring 100, which wedges the slips against the pile 16 so that the gripping edges 112b of the slips provide anchoring engagement with the surface of the pile. The second yoke 118 may be thus rotated clockwise about the pivot pins 114 to a generally horizontal configuration as shown in FIG. 8, which is the same configuration achieved in the safety lock configuration shown in FIG. 9, so that the rollers 126 are lifted sufficiently to ensure adequate upward movement of the lower ring 108 and slips 112 to guarantee anchoring engagement of the slips with the pile 16. To remove the locking mechanism 92 from anchoring engagement with the pile 16 as shown in FIG. 8, the handle 138 may be operated to rotate the second yoke 18 counterclockwise about the pivot pins 114, forcing the second ring 106 downwardly by means of the rollers 126, riding on the ring upper surface to withdraw the slips 112 downwardly from anchoring engagement with the pile 16, and compressing the springs 108, until the inner yoke 128 may be moved forward with the pins 132 moving within the slots 134 to place the upper beveled edges **128*b* against the undersurfaces 116*c* of the first yoke 116, whereby the anchoring configuration of FIGS. 6, 7 and 10** is once again achieved.

Another embodiment of a locking mechanism according to the present invention is shown generally at 140 in FIG. 11 and may utilize many of the components included in the locking mechanism 92 (and like components are identified by their previous number labels in FIG. 11). Thus, the locking mechanism 140 includes, for example, a mounting frame 94 held to the framework 18 of the deck 14, and containing a housing 98 in which is mounted an upper ring 100. A lower ring 106 is urged upwardly by coil springs 108 to drive slips 112 within the upper ring 100 so that, in an upward configuration, the slips 112 are wedged into anchoring engagement against the pile 16, and in a lowered configuration, as illustrated in FIG. 11, the second ring 106 maintains the slips 112 in a downward configuration in which they are free from anchoring engagement with the pile 16.

One or more (one is shown) fluid pressure piston-and-cylinder assemblies 142 are arranged to fit between the undersurface of the upper ring shoulder 102 and the top surface of the second ring 106. Fluid pressure may be introduced through an appropriate terminal and by means of appropriate fluid pressure communication lines (not shown) into the upper portion of the cylinder of the fluid pressure assembly 142, as indicated by the double arrow D, to drive the piston downwardly to expand the fluid pressure assembly 142, thus lowering the second ring 106 to disengage the slips 112 from anchoring engagement with the pile 16. Maintenance of such fluid pressure in the assembly 142 retains the locking mechanism in such disengaged, or open, configuration. Release of fluid pressure within the fluid pressure assembly 142, as also indicated by the double-ended arrow D, allows the spring 108 to drive the second ring 106 and, therefore, the slips 112 upwardly to achieve anchoring engagement between the slips and the pile 16. Consequently, the locking mechanism 142 is selectively operated to open or close, that is, to anchor the deck 14 to the pile 16, or release and retain the deck free to move relative to the pile 14. However, without application of fluid pressure to the fluid pressure assemblies 142, the coil springs 108 retain the locking mechanism 140 in a normally closed, or anchoring configuration.

The flexible line 30 is guided by a sheave 34 mounted on an appropriate axle 144 carried by a bracket 146 mounted within the mounting frame 94. The housing 98 carries a scraper ring 110 for removing debris and accumulated organic matter and the like from the pile 16 whenever the deck 14 is lowered relative thereto.

The lower side of the cylinder of the fluid pressure assembly 142 may be vented since the force of the springs 108 is available to drive the lower ring 106 and the slips 12 upwardly as fluid pressure is relieved from the upper side of the cylinder. In the alternative, the springs 108 may be replaced by fluid pressure communicated to the lower side of the cylinder to drive the piston of the assembly 142 upwardly to selectively anchor the deck 14 to the pile 16 by means of the slips 121 engaging the pile.

Where more than one fluid pressure assembly 142 is utilized in the locking mechanism 140, the fluid pressure assemblies are preferably operated simultaneously, and such simultaneous operation may be ensured by interconnecting the fluid pressure communication lines from the fluid pressure source (not shown) to the cylinders of the individual fluid pressure assemblies in the usual manner to achieve such simultaneous operation. Similarly, where more than one such locking mechanism 140 is utilized on different piles, the locking mechanisms may be operated simultaneously by interconnecting the fluid pressure communication lines to the various fluid pressure assemblies 142 in the usual manner.

It will be appreciated that the selectively-operated locking mechanism 140 shown in FIG. 11 may be utilized in conjunction with a self-tripping safety locking mechanism, which responds to the flexible line 30 supporting the deck 14 going slack, such as the locking mechanism 64 shown in FIGS. 12 and 13 or the locking mechanism 92 shown in FIGS. 6–10. While the deck 14 is in use, that is, while people are on the deck for example, the deck may be anchored to the piles 16 by selectively closing the locking mechanism 140, or the locking mechanism 92 (as shown in FIG. 8) as an extra-added safety measure to ensure against any downward movement of the deck relative to the piles. Then, when it is necessary or desirable to elevate or lower the deck 14, the locking mechanisms may be opened to permit such movement.

Figure 14:
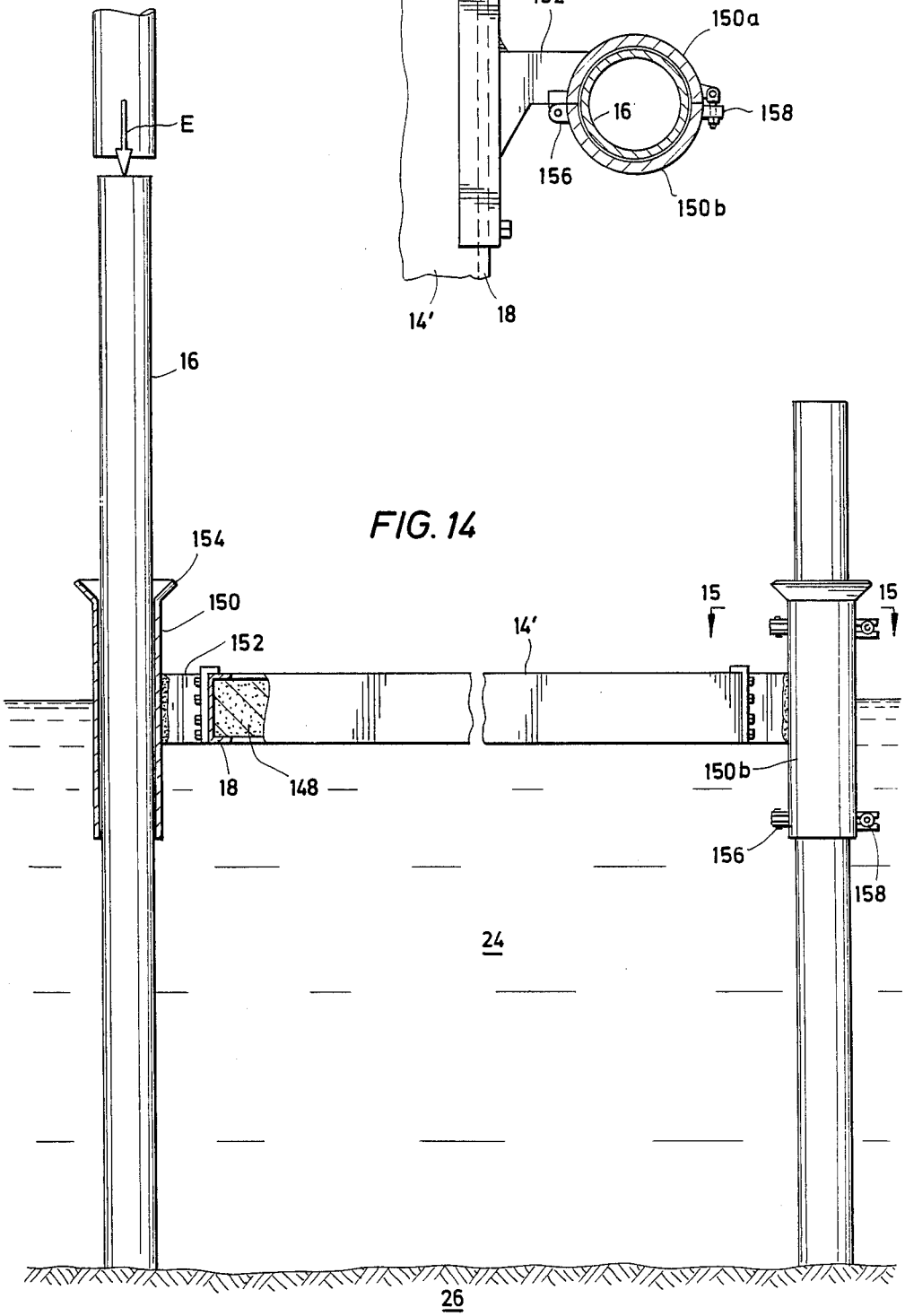
FIG. 14 is an enlarged end elevation, partially broken away and in partial section, showing the use of guides for establishing array of piles for supporting a deck.

To facilitate the arranging of the piles 16 in an array suitable for supporting the deck 14 by means of the flexible lines 30, the deck may be utilized to locate the positions where the individual piles are to be embedded in the seabed. FIG. 14 illustrates a deck 14' which is equipped with flotation material 148 whereby the deck may be floated into position on the water surface. The flotation material 148 may be of any appropriate composition, such as styrofoam, to add sufficient buoyancy to the deck 14'. FIG. 14 illustrates the flotation material 148 generally symbolically, since the material may be added to the deck 14' in any appropriate manner and positions, and FIG. 14 does not show the support mechanisms, such as the reels 36, motor 40, etc., for purposes of clarity.

Generally tubular guides 150 are held to the deck 14' by appropriate brackets 152 bolted to the deck framework 18. With the guides 150 attached, the deck 14' is floated into position and piles 16 passed downwardly through the guides 150 (as indicated by arrow E). The guides 150 are sufficiently long to maintain the piles 16 vertical, that is, perpendicular to the deck 14', while the piles are driven down into the seabed 26 by any appropriate means. The upper end of each guide 150 includes an outwardly-extending, frustoconical lip 154 to facilitate stabbing of the pile 16 into the guide.

After the piles 16 have been driven into place, the guides 150 may be removed and replaced by appropriate locking mechanisms, such as described hereinbefore and illustrated in FIGS. 6–13, for example, and the flexible lines 30 extended and anchored to support the deck 14', which may then be lifted off of the surface of the water 24.

Figure 15:
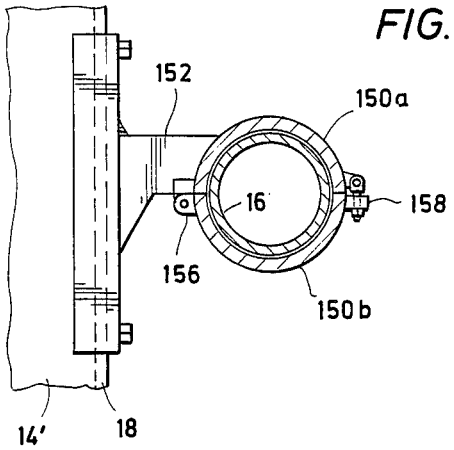
FIG. 15 is a fragmentary, horizontal cross section taken along line 15—15 of FIG. 14.

FIG. 15 illustrates how a guide 150 may be constructed for easy removal after the pile 16 is in place. The tubular guide 150 is constructed generally in two longitudinally-extending halves, the first half **150*a* being connected directly to the bracket 152 and the second half 150***b* being connected to the first half by appropriate hinge assemblies 156. Swing bolt couplings 158 are provided so that the longitudinally-extending guide section halves may be bolted together to form a tubular structure within which the pile 16 may be positioned as illustrated. After the pile 16 is driven into place, the guide section halves 150*a* and 150*b* may be unbolted at the couplings 158 and the second guide half 150*b* swung open on the hinges 156. The bracket 152 may be unbolted from the deck frame 18 and the guide 150 completely removed.

Figure 17:
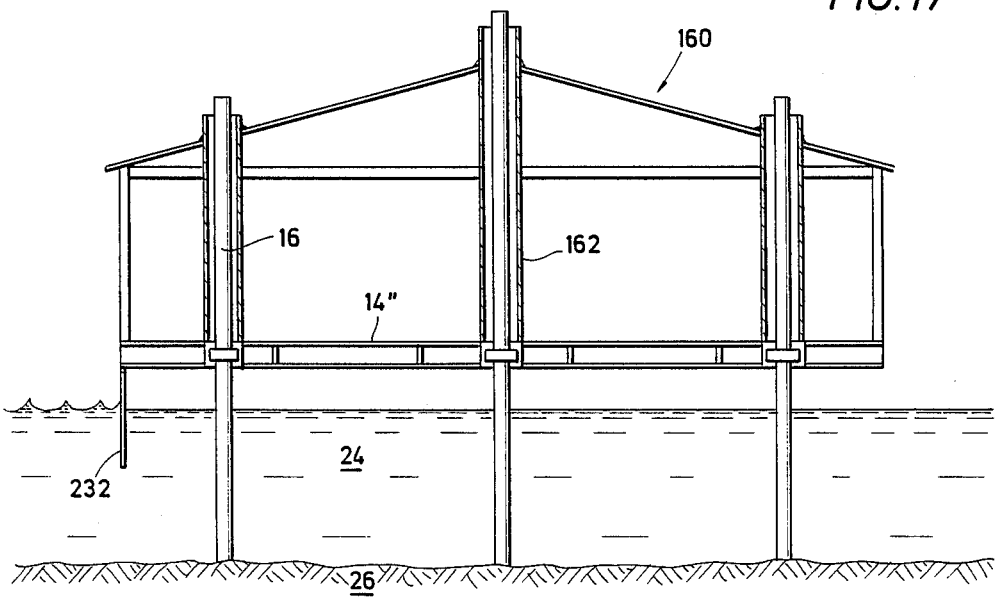
FIG. 17 is a vertical cross section of a pier according to the present invention, showing further detail of the use of piles arrayed within the periphery of the deck.

FIG. 17 illustrates a pier, shown generally at 160, and including an enlarged deck 14'' supported by piles 16 according to the present invention. The lateral extent of the structure 160 is sufficiently large that the array of supporting piles 16 must include piles positioned within the periphery of the deck 14''. The interior piles 16 may extend upwardly through housings 162 which separate the piles from the interior of the structure 160. Such housings 162 may be advantageous where the structure 160 includes living quarters, a restaurant, or like facilities within which the appearance of the piles 16 may not be desirable.

Figure 16:
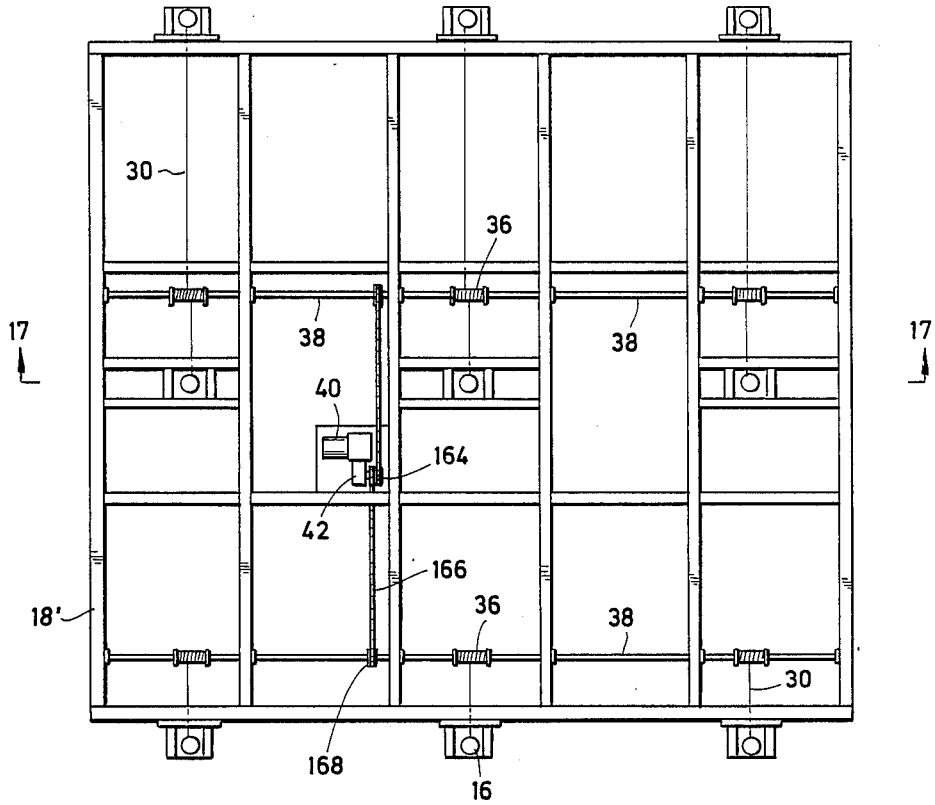
FIG. 16 is a top plan view of the framework of a deck supported by piles according to the present invention, showing piles arrayed within the periphery of the deck and multiple reels interconnected for simultaneous operation.

FIG. 16 illustrats a deck frame 18' for use with such a structure 160 as shown in FIG. 17. It will be appreciated that multiple shafts 38 carrying reels 36 may be required to accommodate more than two rows of piles 16 wherein each pile supports the structure 160 by a flexible line 30. A single motor 40 and gear linkage 42 may be utilized to drive all of the reel shafts 38 simultaneously by means of an appropriate linkage connecting the shafts with the gear box 42.

A double sprocket 164 is connected to and rotatable by the gear linkage 42. Two chains 166 are wrapped about and engage the sprocket 164, extending therefrom in opposite directions to reel shafts 38 where the chains are appropriately engaged by sprockets 168 carried by the shafts. Consequently, operation of the motor 40 rotates the sprocket 164 which causes corresponding rotation of the two shafts 38 by means of the linking chains 166 for simultaneous operation of all reels 36 to elevate or permit the lowering of the deck frame 18'. Any number of piles 16 may be utilized to so support a structure by means of additional shafts 38 and linking chains 166, for example.

Other linking mechanisms, such as drive shafts and beveled gear assemblies, for example, may be utilized in place of the chains 166 and sprockets 164 and 168. Any appropriate linking mechanism may be utilized to operate the reels 36 simultaneously by operation of a single motor 40, for example. Additionally, multiple motors may be utilized where such motors may be appropriately linked for simultaneous operation. For example, fluid pressure motors may be used and interconnected by means of fluid pressure communication lines extending between the motors and an appropriate pressure source so that all motors may be operated simultaneously by means of application of fluid pressure thereto.

In any of the deck structures supported by the flexible lines 30, the motor 40 used to raise or lower the deck may be operated in response to changes in the level of the surface of the body of water over which the deck is supported. FIG. 2 illustrates a sensor device, shown generally at 170, for responding to changes in the level of the water surface 24*a*. The sensor apparatus 170 includes an appropriate support 172 for supporting an upper float 174 and a lower float 176 by arms 178 and 180, respectively. Each of the arms 178 and 180 is appropriately hinged at the support 172 for limited rotational movement to permit the corresponding floats 174 and 176 to move generally vertically a short distance in response to relative movement of the surface of the water 24*a*. The two floats 174 and 176 monitor the level of the water surface 24*a*.

As illustrated in FIG. 2, the water level 24*a* is between the positions of the upper and lower floats 174 and 176, respectively, and no power is supplied to the motor to raise or lower the deck 14. In the configuration thus illustrated, the upper float 174 is hanging downwardly on its arm 178 as far as the combination can rotate about the linkage of the arm to the support 172, and the lower float 176 is raised by buoyancy the greatest extent that the linkage of its arm 180 to the support 172 will permit.

If the water level 24*a* falls so that the lower float 176 rotates downwardly on its arm 180 the short distance permitted by the linkage of the arm with the support 172, the motor operating the reels 36 will be activated to pay out the flexible lines 30 so that the deck 14 will lower on the piles 16. This operation of the motor will continue to lower the deck 14, and the sensor device 170, until the lower float 176 contacts the water surface 24*a* and is elevated by the downward movement of the deck relative to the water, rotating about the linkage between the arm 180 and the support 172, to the maximum extent as illustrated in FIG. 2, at which time the motor will again be deactivated with the result that the deck will be held stationary relative to the piles 16. If the water level 24*a* rises above that illustrated in FIG. 2 to contact the upper float 174, that float will rise with the water level until the upper float is rotated on its arm 178 about the linkage with the support 172 generally to a horizontal configuration like that illustrated for the lower float 176, which would be the maximum height permitted for the upper float 174 relative to the deck 14. In the elevated configuration of float 174, the motor operating the reels is activated to retract the flexible lines 30 to raise the deck 14 along the piles 16. After the deck 14 is elevated to a level wherein the upper float 174, raised by the support 172, is at the surface of the water 24*a* and rotates downwardly on its arm 178 as the deck continues to rise, the motor will be deactivated when the float 174 is suspended downwardly, as illustrated in FIG. 2, even on the water surface 24*a*. It will be appreciated that any type of switch mechanism may be utilized for operating the reel motor in response to the two flotation devices 174 and 176, and may incorporate lost motion linkages to permit the appropriate limited movement of the floats relative to the support 172 before activation or deactivation of the motor as described hereinbefore.

In general, the motor used to operate the line reels may be electrical, hydraulic, or pneumatic as appropriate. The present invention may utilize natural movement of the water over which a deck is supported to power the motor to raise or lower the deck. Such capability may be particularly important where the deck is somewhat remote from sources of electricity, for example, or where it is undesirable to operate an internal combustion engine to raise the deck directly, or to enable the accumulation of fluid pressure to operate a fluid pressure motor.

FIGS. 18 and 19 illustrate, at least partly schematically, a fluid pressure system, shown generally at 182, ultimatelly powered by motion of the body of water 24. In FIG. 18, the fluid pressure system 182 is shown fitted into a deck 14, while FIG. 19 shows the circuit diagram of the system.

A relatively large float 184 is mounted on the end of a lever arm 186, one end of which is pivotally connected to the end of a vertical support 188 extending from the deck 14 so that, as waves move across the water surface 24*a*, the float is made to rise and fall accordingly, swinging in an arc as indicated by the arrow F about the pivot connection of the arm to the support. A piston rod 190 is pivotally connected to the lever arm 186, and is driven upwardly and downwardly, as indicated by the double arrow G, with the rising and falling of the float 184. The piston arm 190 is part of an hydraulic pump 192, which pumps hydraulic fluid as a result of the vertical movement of the piston rod 190 caused by the movement of the flotation device 184.

As hydraulic fluid reservoir 194 is connected to the pump 192 by a fluid communication line 196 which includes a check valve 198. A second fluid communication line extends from the pump 192 through a check valve 202 to one side of an hydraulic fluid accumulator 204. As the piston rod 190 is drawn downwardly in the pump 192, hydraulic fluid is drawn along the line 196 out of the reservoir and through the check valve 198, the second check valve 202 being held closed in that operation. As the piston rod 190 is driven upwardly by the float 184, fluid pressure generated by the pump 192 closes the first check valve 198 and forces the fluid having been drawn through that valve along the fluid communication line 200 and through the check valve 202 into the left side of the accumulator 204. With each stroke of the piston rod 190, more fluid can be added to the left side of the accumulator from the reservoir 194 in this manner.

The interior of the accumulator 204 is divided into two parts by a membrane or the like 206. The left side of the accumulator interior, as viewed in FIG. 19, stores hydraulic fluid; the right side of the interior of the accumulator 204, on the oposite side of the diaphragm 206, is a pneumatic chamber which may be initially pressurized to a higher than atmospheric pressure. A source of additional pneumatic pressure (not shown) may be provided to maintain sufficient charging on the right side of the diaphragm within the accumulator 204. The purpose of the pneumatic pressure in the accumulator 204 is to maintain pressure applied to the hydraulic fluid on the left side of the diaphragm 206, as indicated by the arrow H. In the event of overpressurization of the hydraulic fluid on the left side of the accumulator 204, excess pressure may be relieved by the passage of hydraulic fluid through a check valve 208 and along a fluid communication line 210 back to the reservoir 194. The third check valve 208 is charged to open only above a selected threshold of pressure applied thereto from the right, as viewed in FIG. 19.

A fluid pressure communication line 212 extends from the hydraulic fluid side of the accumulator 204 to a reversible hydraulic motor 40', and a return line 214 extends from the motor back to the reservoir 194. The motor 40' is controlled by means of a three-position hydraulic valve 216, which in turn is controlled by a flotation device 218 which senses the level of the water surface 24*a*. The float 218 is mounted on a lever arm 220 which is pivotally connected to a support 222. A valve connector rod 224 is pivotally connected to the lever arm 220 and extends to the spool of the hydraulic valve 216. As the water level 24*a* rises, the float 218 is elevated and forces the valve 216 to change configurations by moving the spool of the valve upwardly. As the water level 24*a* falls, the float 218 falls, bringing the spool of the valve 216 downwardly accordingly. The connector rod 224 may integrate lost motion, and even resiliency, to cause the valve 216 to respond only to gross changes in the level of the float 218 as opposed to transitory fluctuations in the float due to wave motion or the like. Thus, the general rise and fall of the water level 24*a* rather than merely wave motion on the surface of the water is used to activate a change in the configuration of the valve 216.

The three positions of the valve 216 include connecting the motor 40' to the accumulator line 212 and return line 214 in one fashion, for example as illustrated in FIG. 19, to cause rotation of the motor in one rotational sense due to fluid pressure from the accumulator. As illustrated in FIG. 19, the float 218 is at a low level, which would dictate that the deck 14 be lowered; therefore, the configuration of the valve 216 as illustrated would result in rotation of the motor 40' to cause the reels 36 to pay out flexible line 30 to lower the deck. As the deck 14 is lowered, the flotation support arm 222 is lowered at the same rate. Eventually, the float 218 would rise, relative to the lowering deck 14, due to the float's buoyancy at the surface of the water 24*a*, ultimately shifting the valve 216 up to its middle configuration, which provides a connection between the motor 40' and the return line 214 to the reservoir 194, but which blocks the line 212 from the accumulator 204. In that valve middle configuration, the motor 40' is deactivated, and the deck 14 is held at a stationary level. If the surface of the water 24*a* rises, the flotation device 218 is elevated and, ultimately, will shift the valve 216 to its third configuration which connects the motor 40' to both the source line 212 from the accumulator 204 and to the return line 214 to the reservoir 194, but reverses the connections from that of the first configuration illustrated in FIG. 19. Thus, the motor 40' is reversed in its rotational sense to cause the reels 36 to retract flexible line 30 to elevate the deck 14 along the piles 16. Since the flotation support arm 222 is raised with the deck 14, eventually the float 218 will be lowered, relative to the deck, to remain floating at the surface of the water 24*a*, forcing the valve 216 to return to its middle configuration which deactivates the motor 40'. In this way, the deck 14 is raised or lowered, or held stationary, in response to the gross behavior of the water surface 24*a*.

The spool of the valve 216 may be fitted with an extension 226 equipped with a detent 228 for each of the three valve configurations. The detents 228 cooperate with a resilient stop 230 to ensure that the position of the valve 216 will center on one of the three configurations which connects the valve ports with the fluid communications lines 212 and 214.

It will be appreciated that any other appropriately constructed sensor arrangement may be utilized to control the raising and lowering of the deck 14 in response to change in the level of the water surface 24*a*.

The present invention thus provides a support structure which permits the selective raising and lowering of an object over a body of water, for example, and also provides for such movement of the object in response to the change in level of the surface of the body of water.

A portion of a deck 14 is shown in FIGS. 20 and 21 wherein the deck is fitted with baffles 232, joined by hinge assemblies to the deck framework 18. The baffles 232 extend downwardly from the frame 18 to the body of water 24. The hinge assemblies 234 permit the baffles to be moved back and forth, as indicated by the double-headed arrow I, through an arc in response to wave action acting on the baffles. The purpose of the baffles 232 is to serve as a breakwater to attenuate the wave action so that all or portions of the water surface under the deck 14 may be still, or at least relatively calm, as indicated in FIG. 20, and as shown in FIG. 17 wherein the deck 14" is fitted with at least one baffle. The rotational movement permitted the baffles 232 on their respective hinge assemblies 234 provides a loose coupling between the wave action and the deck 14 so that energy provided by the waves may be harmlessly converted to kinetic energy of the relative massive baffles and so that the wave action itself is attenuated with little significant energy conveyed to the deck.

Details of the hinge assemblies 234 may be appreciated by reference to FIG. 22. Each hinge assembly 234 may include a pair of appropriately spaced ring members 236 welded to a baffle 232 (or baffles where a hinge assembly occurs at the ends of adjacent baffles). A single ring member 238 extends from the deck frame member 18 between the baffle ring members 236, and the three ring members are joined together by a nut-and-bolt assembly 240 passing through the interiors of the respective rings as illustrated. An appropriate bearing 242 circumscribes the bolt within the central ring member 238, and includes end flanges 244 to appropriately isolate the baffle ring members 236 from the central ring member. The end flanges 244 may be integral with the interior portion of the bearing 242, or be provided as separate washer-type bearing members. The bearing structure 242 and 244 may be constructed of any appropriate bearing material, such as plastic or nylon, for example, to prevent metal-on-metal wear within the hinge assembly 234, and to facilitate swinging motion by the baffles 234 in response to the wave motion.

A deck 14 may be fitted with baffles 232 extending down from the periphery of the deck, as well as at various places within the periphery of the deck, to minimize wave interference with flashing or other water related activities carried out through or under the deck, and to prevent water from hitting the bottom of the deck wtih any harmful force. Additionally, water surface level sensors, such as the sensor mechanism 170 illustrated in FIG. 2, or float 218 of the sensor-operated valve 216 shown in FIGS. 18 and 19, may be isolated by baffles 232 to avoid wave action interfering with the operation of such sensing devices to detect the gross level of the body of water over which the deck is suspended to appropriately trigger the raising or lowering of the deck in response to the change in level of the water surface rather than in response to the transitory level changes inherent in such wave action. At the same time that a water surface level sensor is thus isolated from wave action, a flotation mechanism, such as the flotation device 184 of FIGS. 18 and 19, may be exposed to wave action beyond the area so protected by the baffles 232 to appropriately respond to the water motion to provide motive power as discussed hereinbefore.

FIGS. 23 and 24 illustrate the use of standards, fitted about the various piles 16, to limit penetration of the piles into soft seabeds. A standard, shown generally at 246, includes a base portion 248 which contacts the surface of the seabed 26 and extends sufficiently outwardly to prevent any further significant penetration of the pile into the seabed. Struts 250 connect the standard base 248 with a collar assembly 252 which connects the standard to the pile 16 at a higher position than the base.

Details of the construction of the standard 246 may be further appreciated by reference to FIG. 24 wherein the standard is shown to be generally constructed in two halves **246*a* and 246*b*, divided along a vertical plane, so that the standard may be conveniently bolted together to circumscribe a pile 16. Further, the standard base 248 includes a horizontally-positioned flange framework 254 and a vertical lip 256, positioned about the interior edge of the flange. The four struts 250 extend inwardly and upwardly from the interior corners of the lip-and-flange arrangement, and join at the collar 252 with its halves appropriately bolted together and circumscribing the pile 16. A central cross piece 258 extends across the interior face of each base half, and also provides an appropriate collar structure for bolting about the pile 16**.

As a pile 16 is being lowered into the water 24, a standard 256 may be bolted about the pile with the standard base 248 at the location of the pile which is the point to which the pile is desired to be embedded in the seabed 26. Thereafer, the pile 16 may be driven down into the seabed, and when the standard base 248 reaches the surface of the seabed, the standard 246 will prevent the pile from being driven any further downwardly. In the event that the seabed 26 is particularly soft, or muddy, the weight of the pier will be supported, in part, by the standard bases 248 resting on the surface of the seabed with sufficient surface area contacted by the bases, and over a sufficiently large region, that the standards 246 will prevent the piles from sinking any further into the seabed.

It will be appreciated that the standards 246 may be used in conjunction wtih the tubular guides 150 illustrated in FIGS. 14 and 15, with the standards being connected to the piles 16 after they have passed through the tubular guides, or with the piles with standards attached maneuvered into the opened tubular guides, the standards being positioned below the tubular guides, the tubular guides thereafter being bolted closed to guide the piles as described hereinbefore.

The piles 16 may be further interconnected by cables, or lines, 260 extending from the top collar 252 of one standard to the base 248 of the standard of another pile as illustrated. Turnbuckles, winches, or the like, 262 may be provided in conjunction with each of the cables 260 to allow the respective cable to be tightened. Thus, with the piles 16 in place in the seabed 26 as illustrated in FIG. 23, the various cables may be tightened or loosened as needed to pull on the piles to straighten them. As the piles 16 are subject to currents and wave motion, or possible bumping by boats or other moving objects, the lines 260 may be adjusted in their tension to straighten the piles. The lines 260 also help to prevent the piles 16 from being knocked out of alignment initially.

The foregoing disclosure and description of the invention is illustrative and explanatory thereof, and various changes in the method steps as well as in the details of the illustrated apparatus may be made within the scope of the appended claims without departing from the spirit of the invention.

What is claimed is:

1. Apparatus for controlling the position of an object relative to a body of water, comprising:

a. support means, for supporting an object relative to a body of water, and comprising a plurality of upstanding support members arrayed relative to the object whose position is to be controlled and fixed relative to the surface of said body of water;

b. connection means connecting each member with said object, said connection means being adjustable to so connect said object with said members at a plurality of levels;

c. adjustment means for adjusting the connection means to adjust the position of said object relative to said members; and d. lock means for anchoring said object relative to said members to prevent downward movement of said object relative to said members, said lock means being normally open, but closing automatically to prevent said object from falling.

2. Apparatus as defined in claim 1 further comprising at least one counterweight suspended by a flexible line fixed to said object and passing over a sheave supported by a member so that at least a portion of the load of the object is balanced by one or more counterweights.

3. Apparatus as defined in claim 1 wherein:

a. said connection means comprises at least one flexible line, and wherein for each member a flexible line extends between said object and an elevated point on said member; and b. said adjustment means comprises means for retracting or paying out flexible line to thereby shorten or lengthen, respectively, the length of flexible line extending between said object and said points on said members.

4. Apparatus as defined in claim 3 wherein said adjustment means further comprises motor means for operating said means for gathering in or paying out said flexible lines.

5. Apparatus as defined in claim 4 further comprising control means for operating said motor means depending on the location of the surface of said body of water relative to said object.

6. Apparatus as defined in claim 3 wherein said lock means comprises slips and a wedging surface, carried by said object, whereby said object may be so anchored relative to at least one said member by said wedging surface urging said slips in anchoring engagement with said member.

7. Apparatus as defined in claim 6 wherein said lock means further comprises means for preventing said slips from being so urged into anchoring engagement by said wedging surface when said corresponding flexible line is taut.

8. Apparatus as defined in claim 3 wherein said lock means comprises ratchet means.

9. Apparatus as defined in claim 8 wherein said ratchet means is disengaged as long as said corresponding flexible line is taut, and said lock means further comprises means for urging said ratchet means to engage when said corresponding flexible line is slack.

10. Apparatus as defined in claim 3 wherein said means for retracting or paying out said flexible line comprises a plurality of reels for storing said flexible lines, and wherein said reels are interconnected for simultaneous operation.

11. Apparatus as defined in claim 3 further comprising at least one sheave positioned at said elevated point on a member, and wherein said corresponding flexible line passes over said sheave and is anchored to said object.

12. Apparatus as defined in claim 1 further comprising motive means powered by movement of said body of water to operate said adjustment means for raising or lowering said object relative to said members.

13. Apparatus as defined in claim 1 further comprising flotation means for sensing change in the position of the surface of said body of water and operating said adjustment means in response thereto.

14. Apparatus for controlling the configuration of a pier or the like relative to a body of water, comprising:

a. a plurality of piles arrayed to support a deck of said pier;

b. flexible lines connecting said deck to said piles whereby each said pile is so connected to said deck by a flexible line extending between said deck and a point elevated on said pile;

c. means for retracting or paying out said flexible lines to shorten or lengthen the length of flexible lines extending between said deck and said elevated pile points to raise or lower, respectively, said deck relative to said piles; and d. lock means, carried, at least in part, by said deck for engaging at least one pile to anchor said deck against downward movement relative to said pile, said lock means being normally open when said corresponding flexible line is taut, but closed to so anchor said deck to said pile when said corresponding flexible line is slack.

15. Apparatus as defined in claim 14:

a. wherein said means for retracting or paying out said flexible lines are carried by said deck; and b. further comprising sheaves carried by said deck and about which said flexible lines may turn in extending from said deck to said elevated pile points.

16. Apparatus as defined in claim 15 further comprising motor means for powering said means for retracting or paying out said flexible lines.

17. Apparatus as defined in claim 16 further comprising control means for operating said motor means to raise or lower said deck relative to said piles.

18. Apparatus as defined in claim 17 wherein said control means comprises flotation means for sensing change in the location of the surface of said body of water and controlling the operation of said motor means in response thereto.

19. Apparatus as defined in claim 16 further comprising motive means powered by movement of said water to operate said motor means.

20. Apparatus as defined in claim 14 wherein said lock means comprises slips and a wedging surface, carried by said deck, whereby said deck may be so anchored relative to at least one said pile by said wedging surface urging said slips in anchoring engagement with said pile.

21. Apparatus as defined in claim 20 wherein said lock means further comprises means for preventing said slips from being so urged into anchoring engagement by said wedging surface when said corresponding flexible line is taut.

22. Apparatus as defined in claim 14 wherein said lock means comprises ratchet means.

23. Apparatus as defined in claim 22 wherein said ratchet means is disengaged as long as said corresponding flexible line is taut, and said lock means further comprises means for urging said ratchet means to engage when said corresponding flexible line is slack.

24. Apparatus as defined in claim 14 further comprising control means for controlling the operation of said means for retracting or paying out said flexible lines.

25. Apparatus as defined in claim 25 wherein said control means comprises flotation means for sensing change in the location of the surface of said body of water and controlling the operation of said means for retracting or paying out said flexible lines in response thereto.

26. Apparatus as defined in claim 14 further comprising at least one counterweight suspended by a flexible line fixed to said deck and passing over a sheave supported by a pile so that at least a portion of the load of said deck is balanced by one or more counterweights.

27. Apparatus as defined in claim 14 further comprising motive means powered by movement of said water to operate said means for retracting or paying out said flexible lines.

28. Apparatus as defined in claim 14 further comprising guide means for carrying by said deck to define positions of said piles relative to said deck and to guide said piles while said piles are being arranged to support said deck.

29. Apparatus as defined in claim 14 wherein said means for retracting or paying out said flexible lines comprises a plurality of reels for storing said flexible lines, and wherein said reels are interconnected for simultaneous operation.

30. Apparatus as defined in claim 14 further comprising at least one sheave positioned at said point elevated on a pile, and wherein said corresponding flexible line passes over said sheave and is anchored to said deck.

31. Apparatus as defined in claim 14 further comprising at least one baffle, suspended from said deck and free to swing in an arc for engaging said body of water and attenuating wave motion thereof.

32. Apparatus as defined in claim 14 further comprising means for preventing said piles from sinking into the bed below said body of water.

33. A method for controlling the configuration of a pier, or the like, relative to a body of water, comprising the following steps:

a. suspending the deck of the pier by flexible lines from a plurality of piles, with the lines extending between the deck and elevated points on each of the piles;

b. retracting or paying out the flexible lines by means of one or more reels to adjust the length of flexible lines extending between the deck and the elevated pile points;

c. controlling the step of retracting or paying out the flexible lines to so adjust the configuration of the deck relative to the piles; and d. locking the deck in anchoring engagement with at least one pile to prevent downward movement of the deck relative to the piles in response to the corresponding flexible line being slack.

34. A method as defined in claim 33 further including providing motor means for operating at least the retraction of the flexible lines.

35. A method as defined in claim 34 wherein the motor means is powered by one or more flotation devices moving under the influence of movement of the water.

36. A method as defined in claim 33 wherein the step of controlling the operation of retraction or paying out of the flexible lines is effected by at least one flotation device reacting to the rise or fall of the surface of the body of water relative to the piles.

37. A method as defined in claim 33 further comprising the step of providing counterweights to counterbalance at least a portion of the load of the deck by means of at least one flexible line extending between such weight and the deck and passing over a sheave carried at an elevated location by a pile.

38. A method as defined in claim 33 further comprising the steps of providing guides carried by said deck, and positioning and controlling said piles with said guides as said piles are anchored to the seabed under the water in an array for supporting the deck.

39. A method as defined in claim 33 wherein a plurality of means are provided for retracting or paying out a plurality of flexible lines and are interconnected and operated simultaneously.

40. A method as defined in claim 33 further comprising the step of providing at least one baffle suspended by hinges from said deck for engaging the body of water to attenuate wave motion thereof.

41. A method as defined in claim 33 further comprising the step of providing means for preventing the piles from sinking into the bed below the body of water.

* * * * *

UNITED STATES PATENT AND TRADEMARK OFFICE

CERTIFICATE OF CORRECTION

PATENT NO. : 4,740,108

DATED : April 26, 1988

INVENTOR(S) : Leonard Edward Levee

It is certified that error appears in the above-identified patent and that said Letters Patent is hereby corrected as shown below:

In Column 21, line 4, delete "25" and insert therefor --24--.

Signed and Sealed this

Twenty-fifth Day of October, 1988

*Attest:*

DONALD J. QUIGG

*Attesting Officer*

*Commissioner of Patents and Trademarks*